US008474096B2

(12) United States Patent
Thompson et al.

(10) Patent No.: US 8,474,096 B2
(45) Date of Patent: Jul. 2, 2013

(54) TRUCK AND TRAILER DOOR SAFETY DEVICE

(75) Inventors: Timothy B. Thompson, Granville, IL (US); Jeffrey C. Bassett, Oglesby, IL (US); Nicholas R. Tonozzi, Peru, IL (US); Richard T. Rundle, Peru, IL (US); Mike E. Daly, Shakopee, MN (US); Dale H. Peleski, Lake Elmo, MN (US); Tom G. Peterson, Eden Prairie, MN (US); Harvey E. Boyles, Shaw, MS (US); Bennie L. Dickerson, Holcomb, MS (US); Claudie D. Morgan, Bellevue, IL (US); William H. Hough, Thomasboro, IL (US); Danny R. Dale, Thomasboro, IL (US)

(73) Assignee: Supervalu, Inc., Eden Prairie, MN (US)

( * ) Notice: Subject to any disclaimer, the term of this patent is extended or adjusted under 35 U.S.C. 154(b) by 219 days.

(21) Appl. No.: 12/852,955

(22) Filed: Aug. 9, 2010

(65) Prior Publication Data

US 2011/0209411 A1 Sep. 1, 2011

Related U.S. Application Data

(60) Provisional application No. 61/232,755, filed on Aug. 10, 2009.

(51) Int. Cl.
*E05F 5/02* (2006.01)

(52) U.S. Cl.
USPC ..... 16/82; 16/DIG. 1; 49/322; 292/262; 292/DIG. 36

(58) Field of Classification Search
USPC ..... 16/82, 83, DIG. 1, 49; 49/506, 322; 160/201; 292/262, 278, DIG. 19, DIG. 36, 292/DIG. 15; 52/173.2
See application file for complete search history.

(56) References Cited

U.S. PATENT DOCUMENTS

| | | | | | |
|---|---|---|---|---|---|
| 2,185,828 | A | | 1/1940 | Blodgett | |
| 2,651,817 | A | | 9/1953 | Moler | |
| 2,869,183 | A | | 1/1959 | Smith | |
| 2,971,790 | A | | 2/1961 | Reid et al. | |
| 3,258,062 | A | | 6/1966 | Lambert | |
| 3,363,273 | A | | 1/1968 | Chitwood et al. | |
| 3,426,829 | A | | 2/1969 | McDaniel et al. | |
| 3,894,761 | A | | 7/1975 | Brennan, Jr. | |
| 4,062,577 | A | * | 12/1977 | Butterfield et al. | 292/262 |
| 4,335,911 | A | * | 6/1982 | Taylor | 292/262 |
| 4,605,353 | A | * | 8/1986 | Hahn et al. | 414/401 |
| 5,273,326 | A | * | 12/1993 | Kinkaide | 292/272 |
| 5,544,088 | A | | 8/1996 | Aubertine et al. | |
| 6,478,348 | B2 | * | 11/2002 | Lahey | 292/264 |
| 6,655,088 | B1 | | 12/2003 | Hörmann | |
| 7,114,291 | B2 | | 10/2006 | David | |
| 2011/0000134 | A1 | * | 1/2011 | Thibeault | 49/70 |

* cited by examiner

*Primary Examiner* — William L. Miller
(74) *Attorney, Agent, or Firm* — Merchant & Gould, P.C.

(57) ABSTRACT

An overhead door safety system includes a loading dock having a loading dock wall defining an opening. A truck and trailer door safety device is mounted to the loading dock wall. The truck and trailer door safety device includes a mounting bracket adapted for mounting to the loading dock wall and a swing arm. The swing arm includes an arm extension portion and a pivot portion. The pivot portion is pivotally mounted to the mounting bracket so that the swing arm pivots about a pivot axis between a retaining position and a storage position. In the retaining position, the arm extension portion is disposed beneath an overhead door of a truck positioned adjacent to the opening of the loading dock wall to prevent the overhead door from closing.

14 Claims, 20 Drawing Sheets

TRUCK AND TRAILER DOOR SAFETY DEVICE

CROSS REFERENCE TO RELATED APPLICATION

This application claims the benefit of provisional application Ser. No. 61/232,755, filed Aug. 10, 2009, which is incorporated herein by reference in its entirety.

BACKGROUND

Overhead doors of a delivery truck or trailer are used to gain and secure access to a truck bay of the delivery truck or trailer. Typically, the delivery truck or trailer is backed up to a loading dock such that the overhead door of the delivery truck faces the loading dock. Once a truck or trailer is backed up to a loading dock, the overhead door is opened such that the goods can be either loaded or unloaded. Although the overhead doors of delivery trucks and trailers vary in configuration, many operate in a vertical direction from a closed position to an open position. This type of door can also be generally referred to as a roll-up door.

There are many safety devices that have been developed to retain an overhead door in the overhead position that are mounted on the truck or trailer itself. However, these mechanisms are sometimes ineffective due to lack of maintenance, or are not even installed in some instances. Without an effective safety device, the overhead door can unexpectedly and forcefully close. As such, a potentially dangerous situation exists for the personnel who are responsible for loading and unloading the truck or trailer. This is especially true when the owner or operator of the truck or trailer is not under the control of the deliverer or recipient of the goods. Resultantly, improvements are desired to increase worker safety at loading dock areas.

SUMMARY

An aspect of the present disclosure relates to a truck and trailer door safety device. The truck and trailer door safety device includes a mounting bracket and a swing arm. The mounting bracket is adapted for mounting at a loading dock wall. The swing arm includes an arm extension portion and a pivot portion. The pivot portion is pivotally mounted to the mounting bracket so that the swing arm pivots about a pivot axis between a retaining position and a storage position.

Another aspect of the present disclosure relates to an overhead door safety system. The overhead door safety system includes a loading dock having a loading dock wall defining an opening. A truck and trailer door safety device is mounted to the loading dock wall. The truck and trailer door safety device includes a mounting bracket adapted for mounting to the loading dock wall and a swing arm. The swing arm includes an arm extension portion and a pivot portion. The pivot portion is pivotally mounted to the mounting bracket so that the swing arm pivots about a pivot axis between a retaining position and a storage position. In the retaining position, the arm extension portion is disposed beneath an overhead door of a truck or trailer positioned adjacent to the opening of the loading dock wall to prevent the overhead door from closing.

Another aspect of the present disclosure relates to a truck and trailer door safety device. The safety device includes a mounting bracket, a swing arm, a pivot assembly and a latch pin. The mounting bracket is adapted for mounting at a loading dock wall. The mounting bracket includes a back plate and a pivot assembly. The pivot assembly is engaged to the back plate. The pivot assembly includes a pivot plate defining an opening and a latch pin opening. The swing arm includes an arm extension portion and a pivot portion. The pivot portion is mounted to the pivot plate of the mounting bracket at the opening. The pivot portion defines a pivot opening and a latch opening. The pivot assembly is engaged to the mounting bracket at the opening and the swing arm at the pivot opening. The pivot assembly defines a pivot axis about which the swing arm pivots between a retaining position and a storage position. The latch pin is adapted for engagement with the latch opening of the pivot portion of the swing arm and the latch pin opening of the pivot plate to secure the swing arm in the retaining position.

Another aspect of the present disclosure relates to a method for preventing a truck or trailer overhead door that is in an open position from unintentionally moving to a closed position, the method includes backing a truck having an overhead door to a loading dock location. The overhead door is opened to an open position. A swing arm of a truck and trailer door safety device is moved to a retaining position wherein at least a portion of the swing is extended below the overhead door that is in the open position. The truck and trailer door safety device is mounted to a loading dock wall.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

Figure 16:
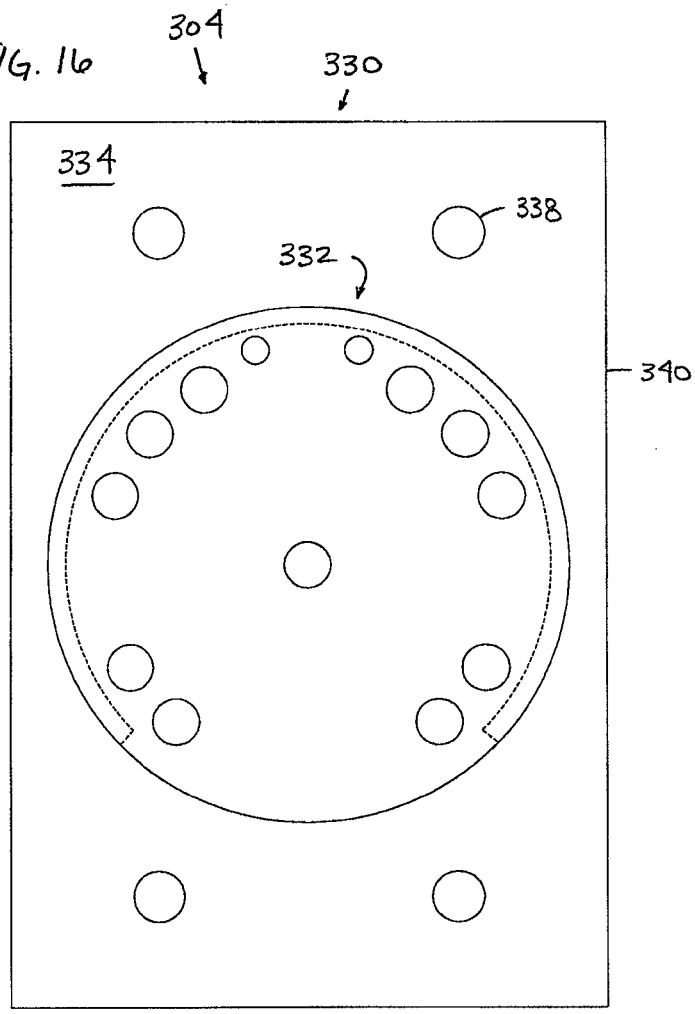
FIG. 16 is a front view of a mounting bracket that is suitable for use with the door safety device of FIG. 12.
Figure 19:
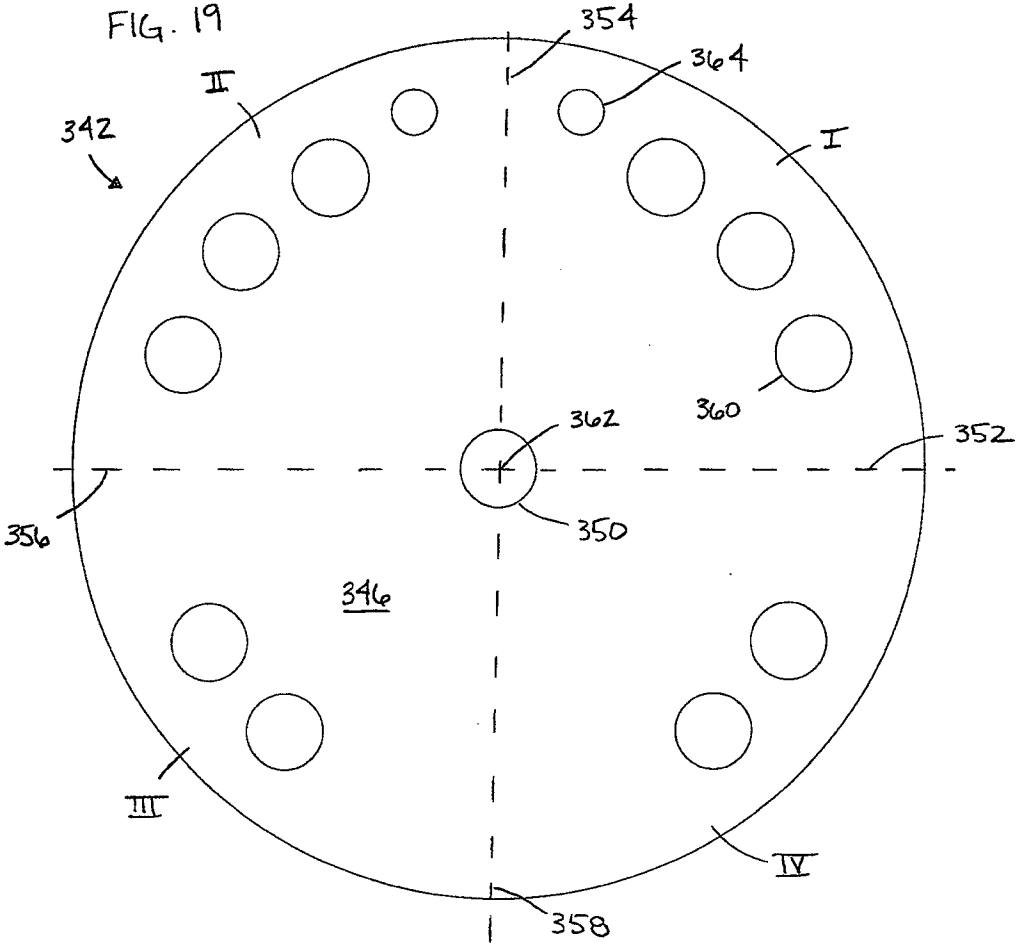

FIG. 19 a front view of a pivot plate that is suitable for use with the mounting bracket of FIG. 16.

Figure 20:
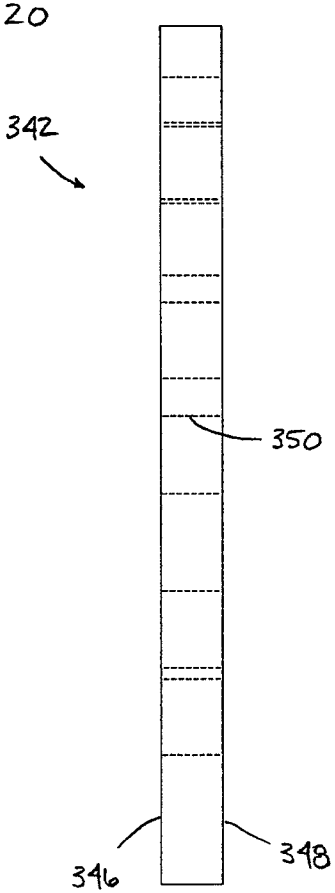

FIG. 20 is a side view of the pivot plate of FIG. 19.

Figure 21:
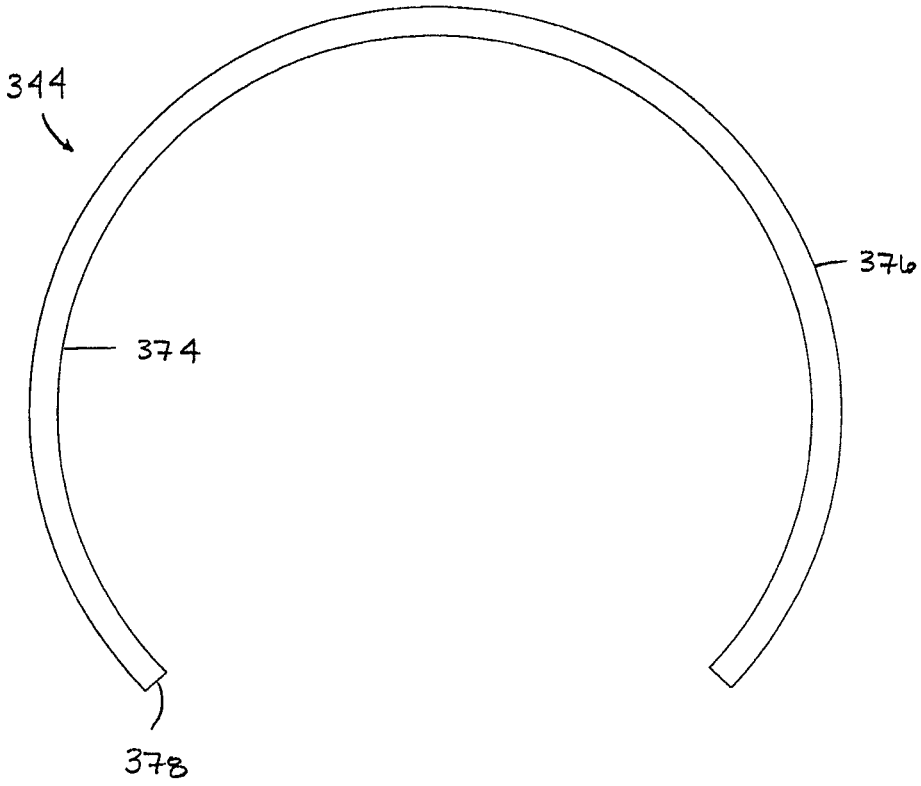

FIG. 21 is a front view of a spacer that is suitable for use with the mounting bracket of FIG. 16.

Figure 22:
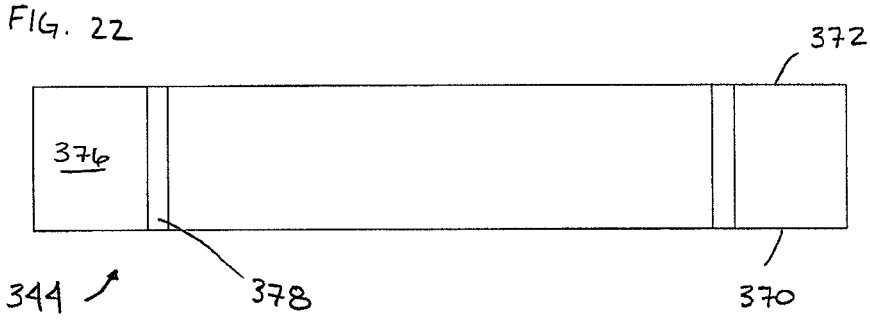

FIG. 22 is a bottom view of the spacer of FIG. 21.

Figure 23:
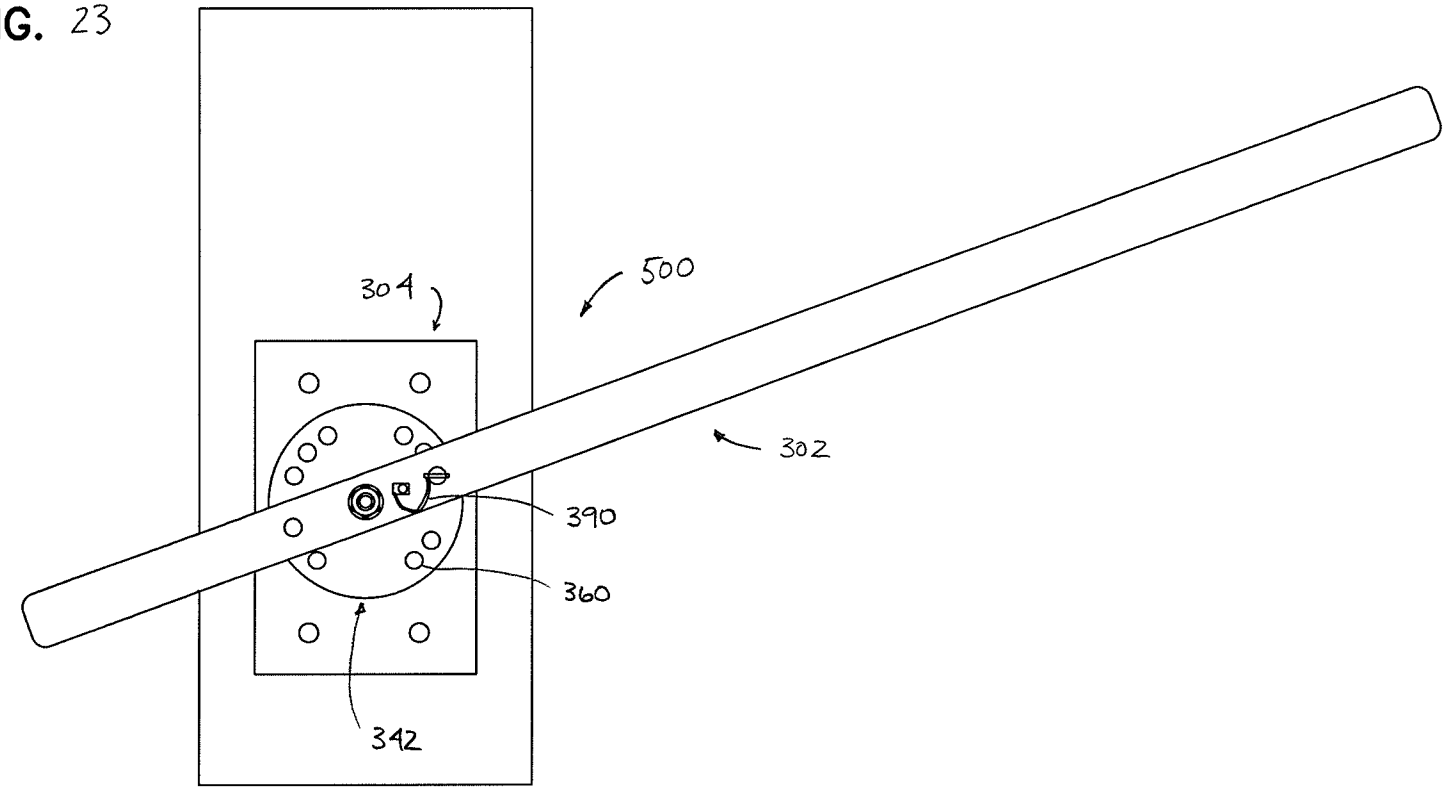

FIG. 23 is a front view of an alternate embodiment of a door safety device.

Figure 24:
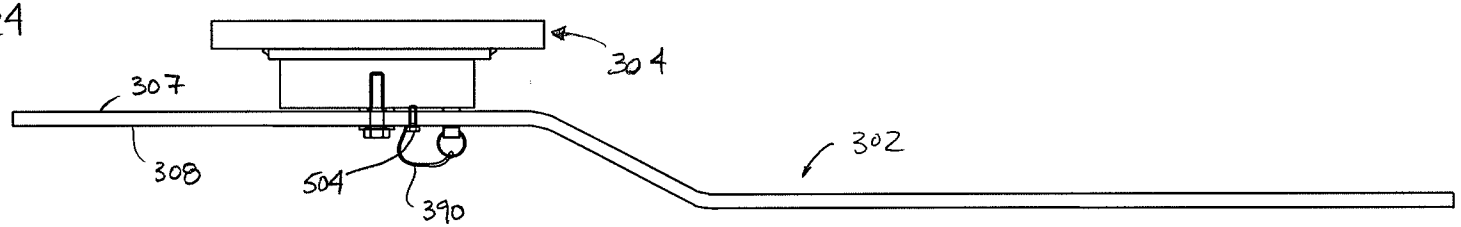

FIG. 24 is a top view of the door safety device of FIG. 23.

Figure 25:
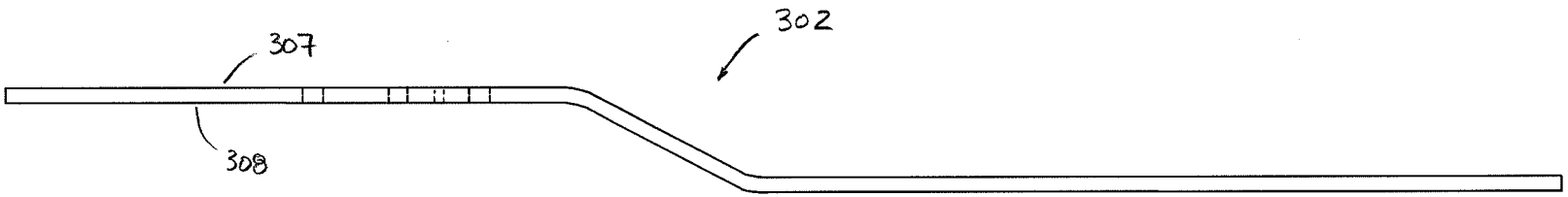

FIG. 25 is a top view of a swing arm that is suitable for use with the door safety device of FIG. 23.

Figure 26:
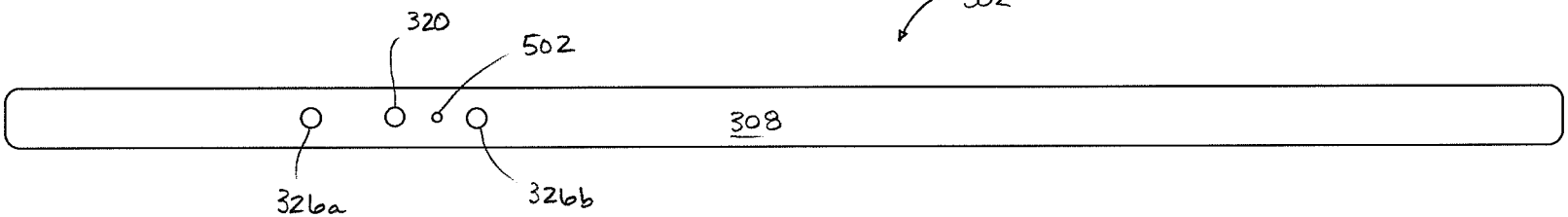

FIG. 26 is a front view of the swing arm of FIG. 25.

Figure 27:
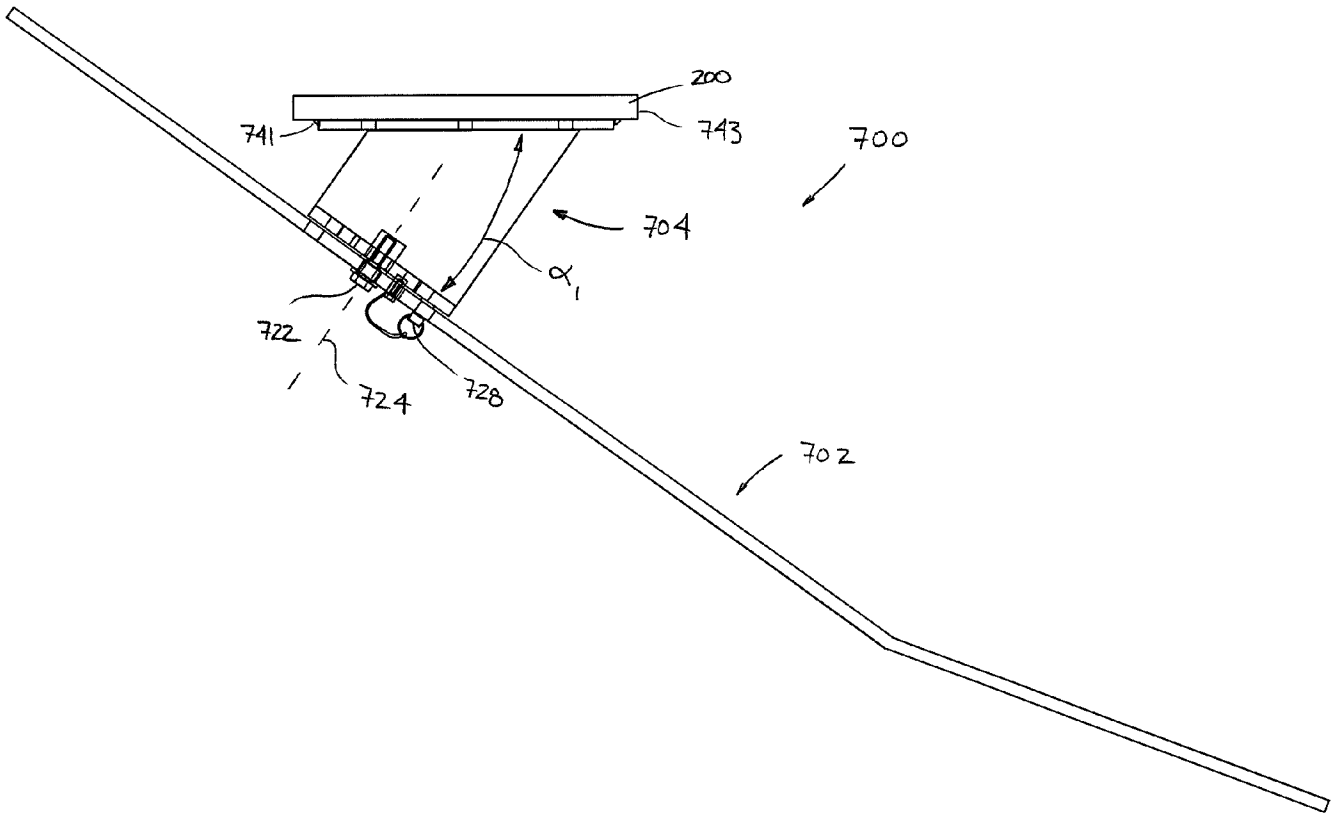

FIG. 27 is a top view of an alternate embodiment of a truck and trailer door safety device.

Figure 28:
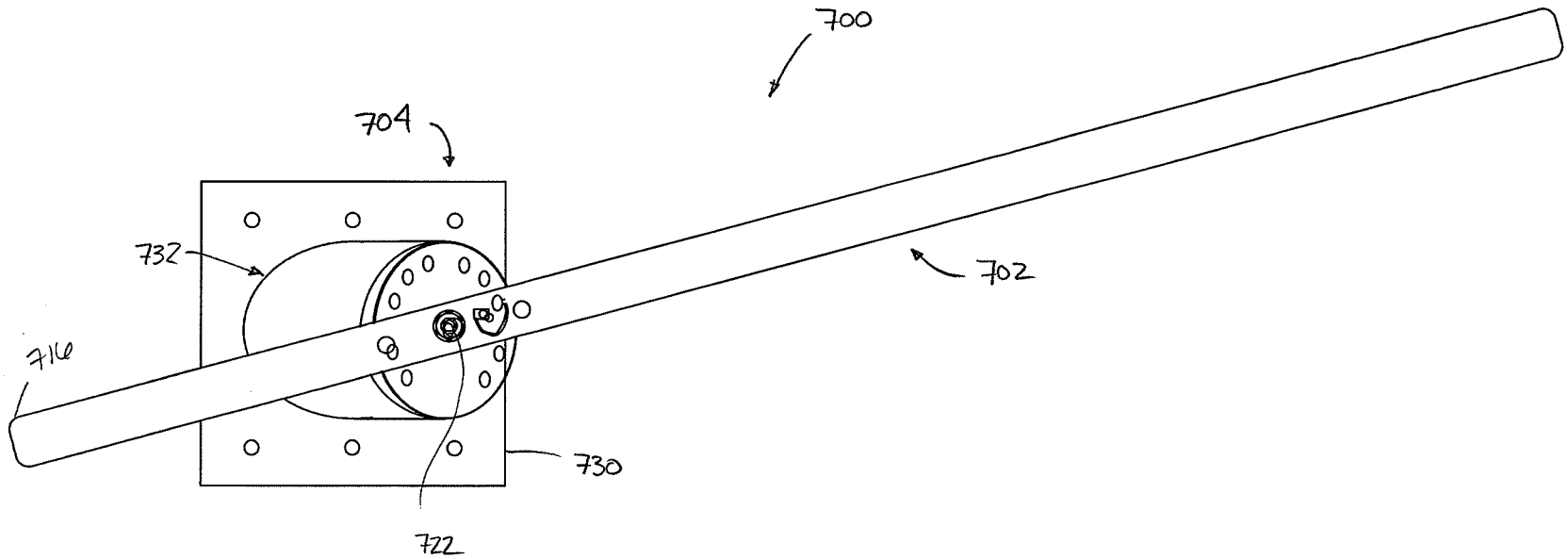

FIG. 28 is a front view of the door safety device of FIG. 27.

Figure 29:
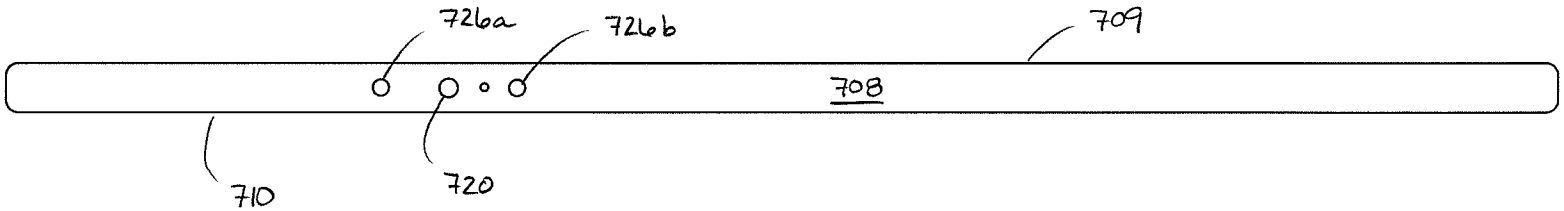

FIG. 29 is a front view of a swing arm suitable for use with the door safety device of FIG. 27.

Figure 30:
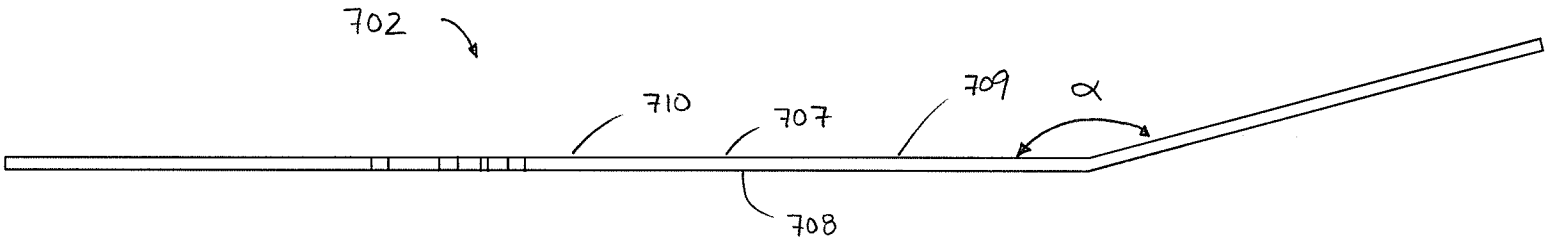

FIG. 30 is a top view of the swing arm of FIG. 29.

Figure 31:
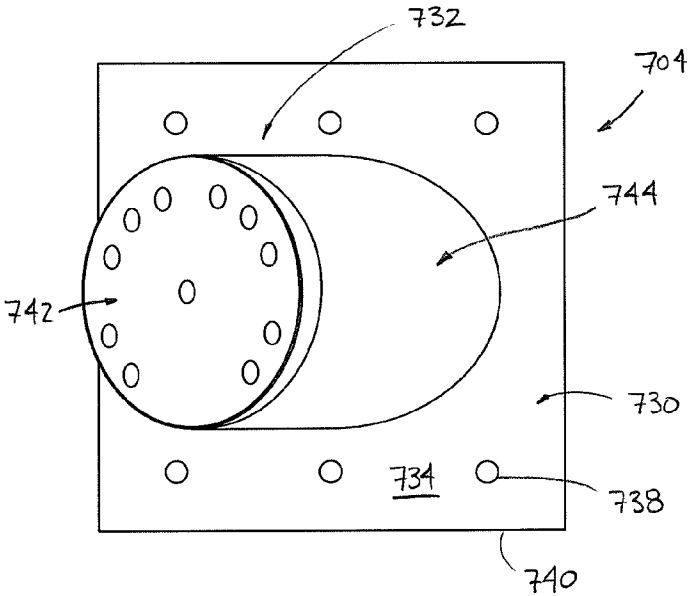

FIG. 31 is a front view of a mounting bracket suitable for use with the door safety device of FIG. 27.

Figure 32:
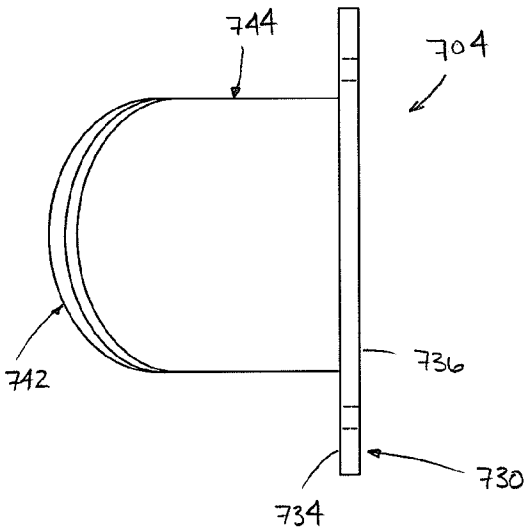

FIG. 32 is a side view of the mounting bracket of FIG. 31.

Figure 33:
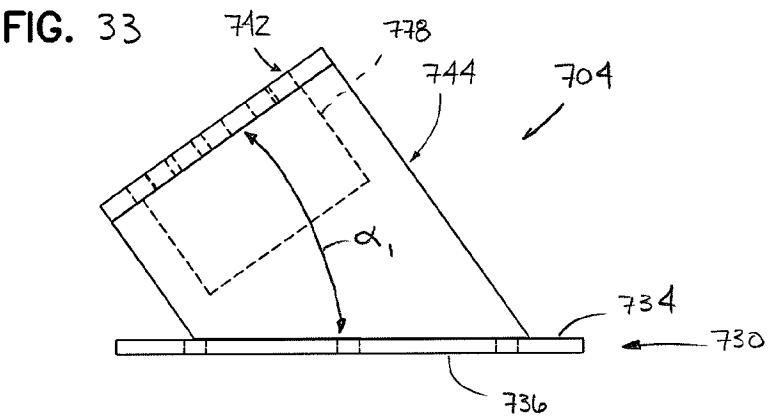

FIG. 33 is a top view of the mounting bracket of FIG. 31.

Figure 34:
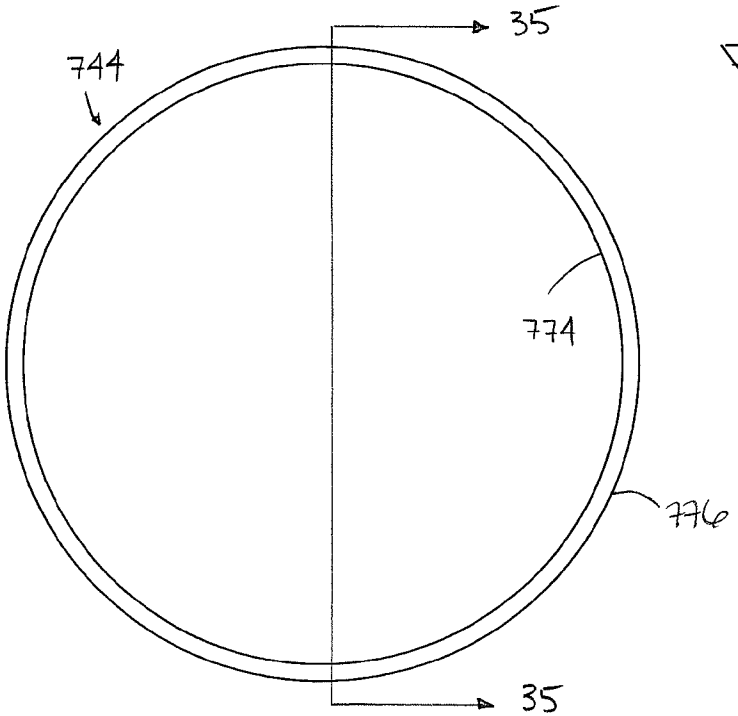

FIG. 34 is an end view of a spacer suitable for use with the mounting bracket of FIG. 31.

Figure 35:
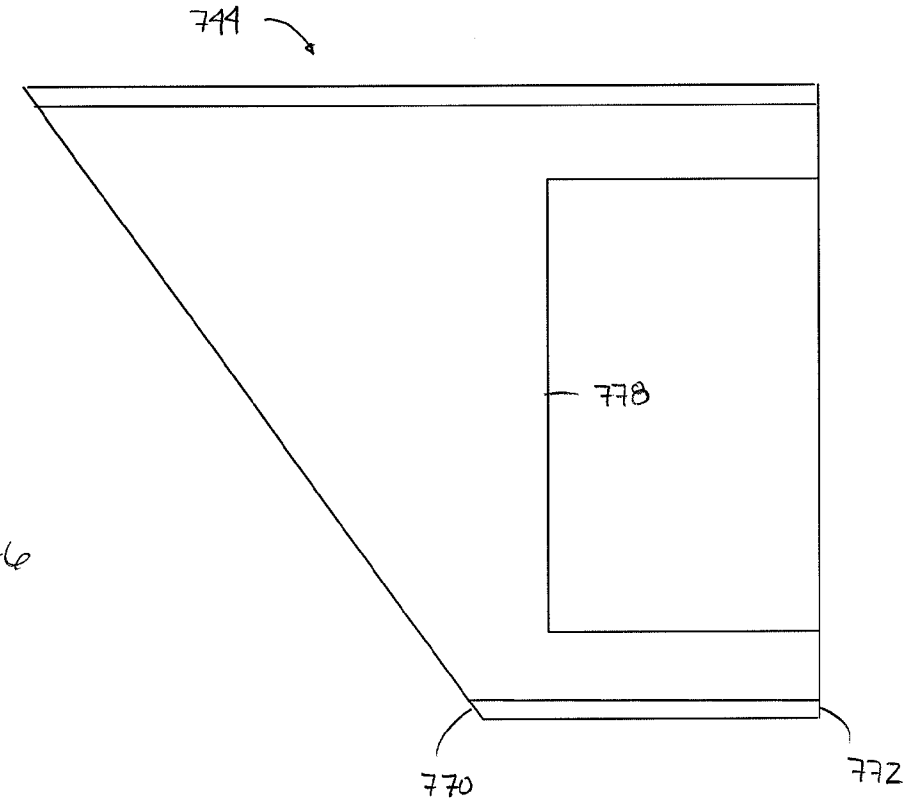

FIG. 35 is a cross-sectional view of the spacer taken on line 35-35 of FIG. 34.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
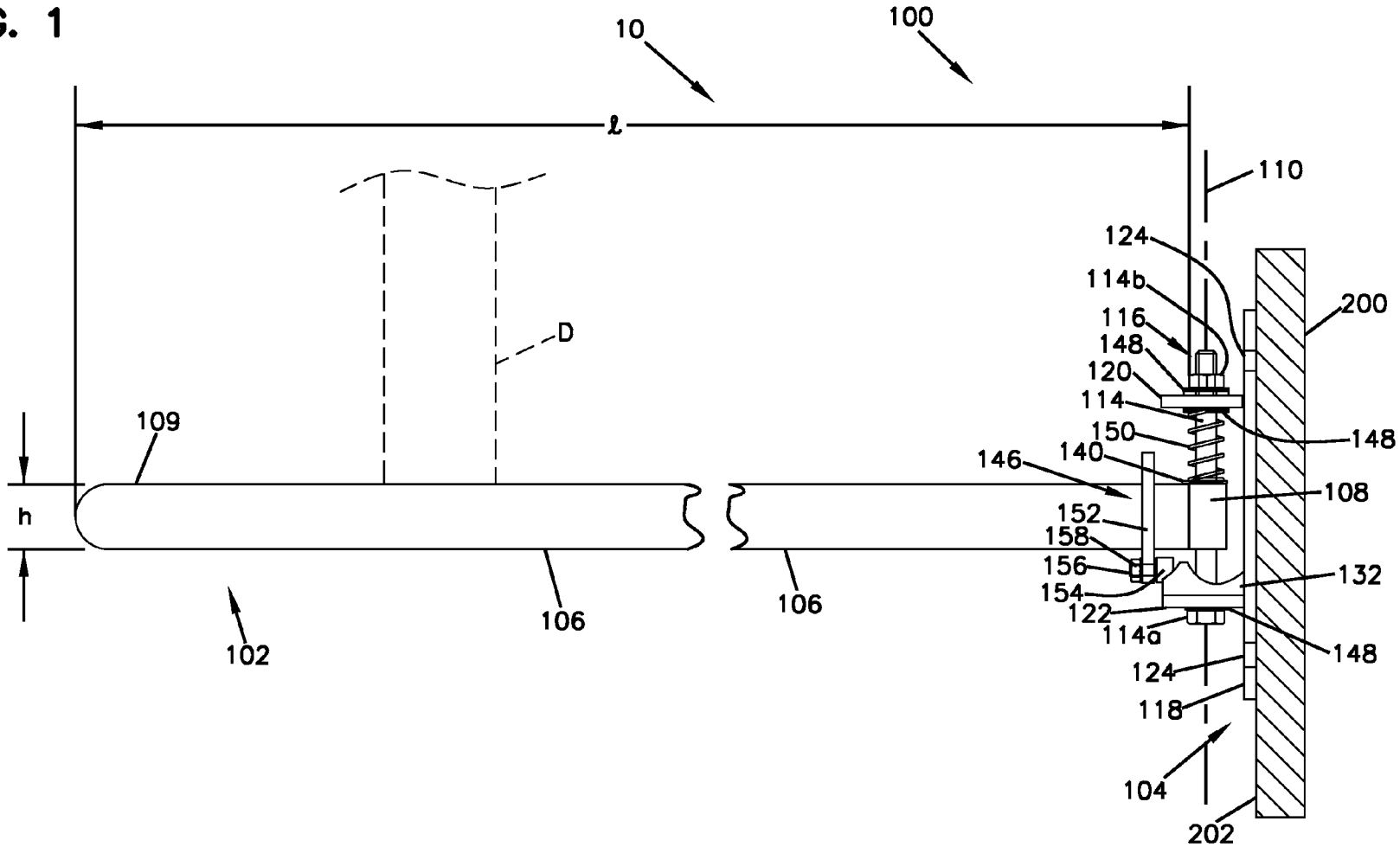
FIG. 1 is a side view of a truck and trailer door safety device having exemplary features of aspects in accordance with the principles of the present disclosure.
Figure 2:
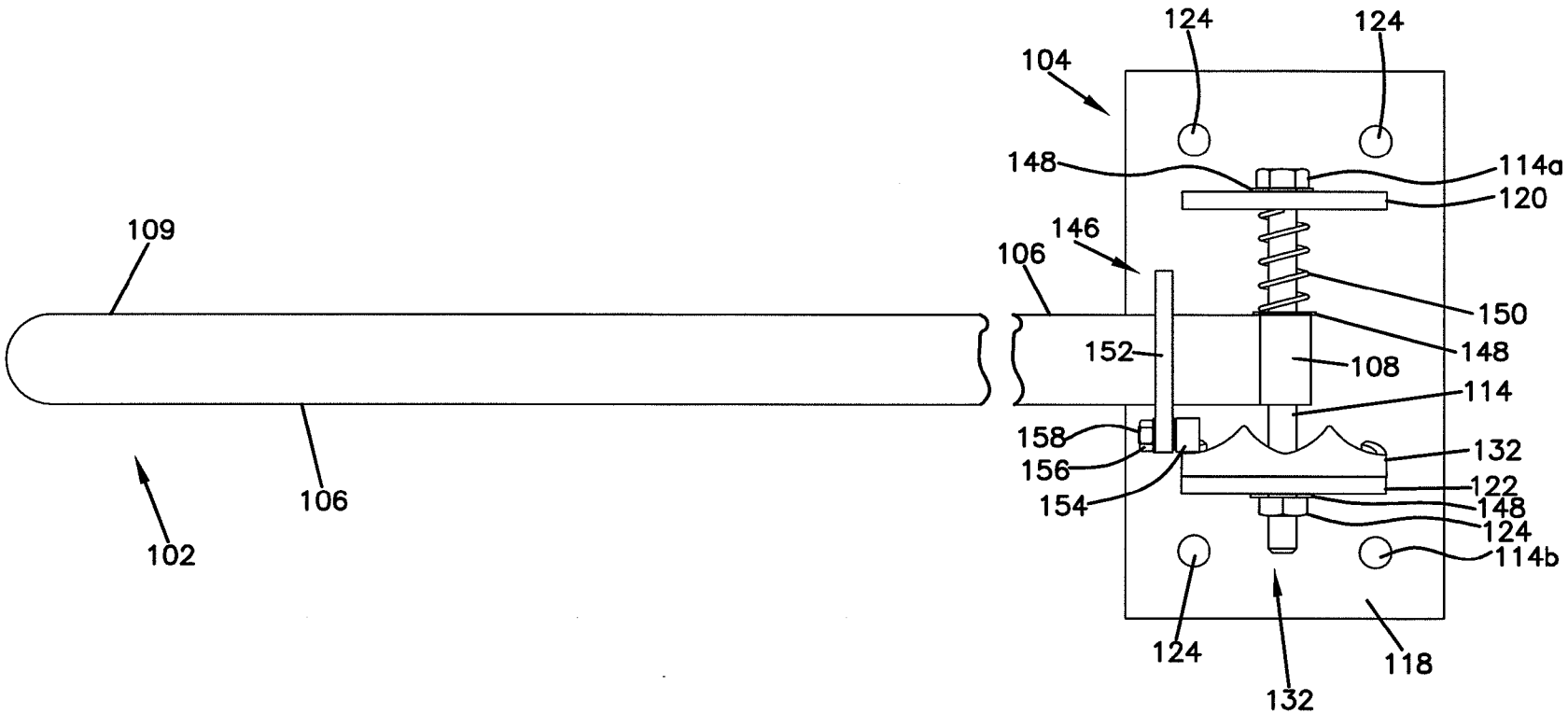
FIG. 2 is a front view of the door safety device of FIG. 1 with the swing arm in a stored position.
Figure 3:
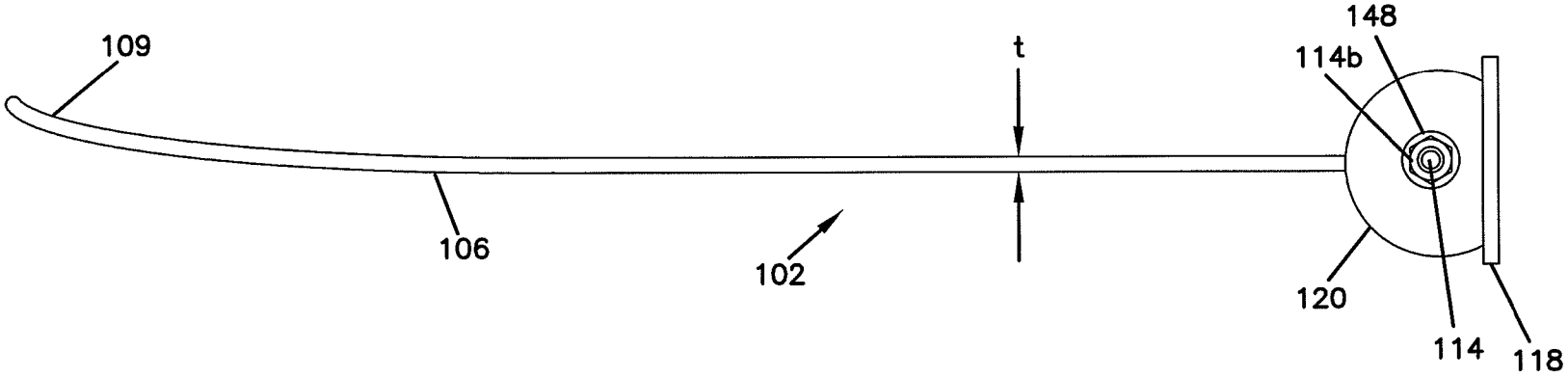
FIG. 3 is a top view of the door safety device of FIG. 1.
Figure 4:
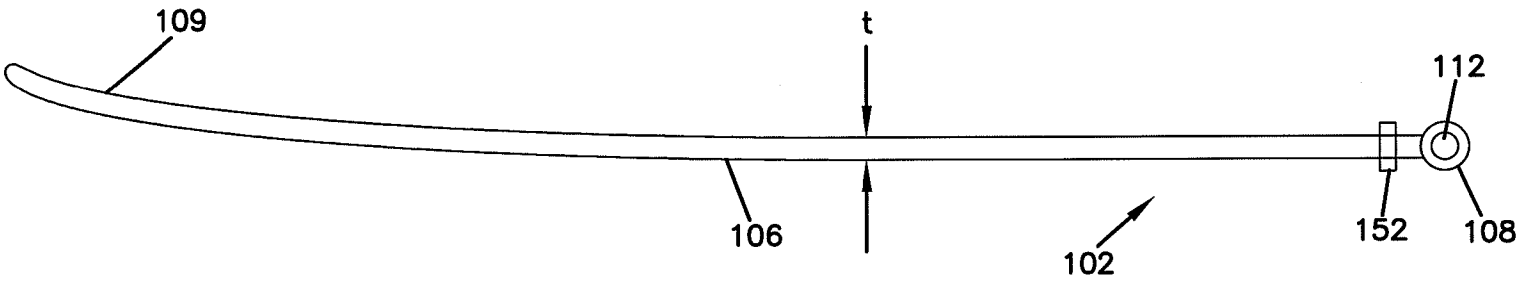
FIG. 4 is a top view of a swing arm that is suitable for use with the door safety device of FIG. 1.
Figure 7:
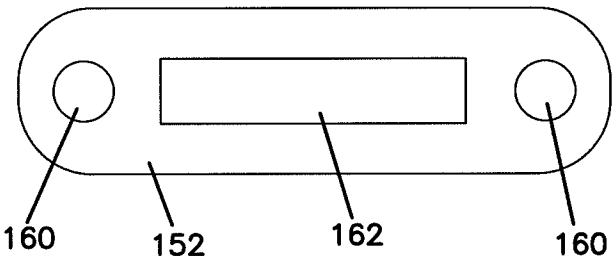
FIG. 7 is a front view of a cam assembly bracket that is suitable for use with the door safety device of FIG. 1.
Figure 5:
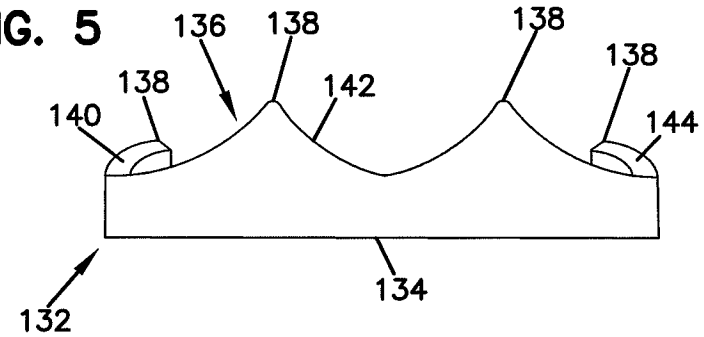
FIG. 5 is a front view of a return guide that is suitable for use with the door safety device of FIG. 1.
Figure 6:
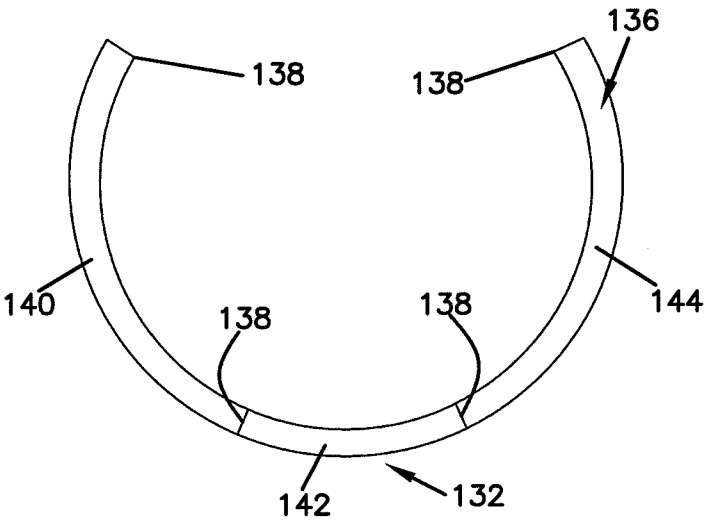
FIG. 6 is a top view of the return guide of the door safety device of FIG. 1.
Figure 9:
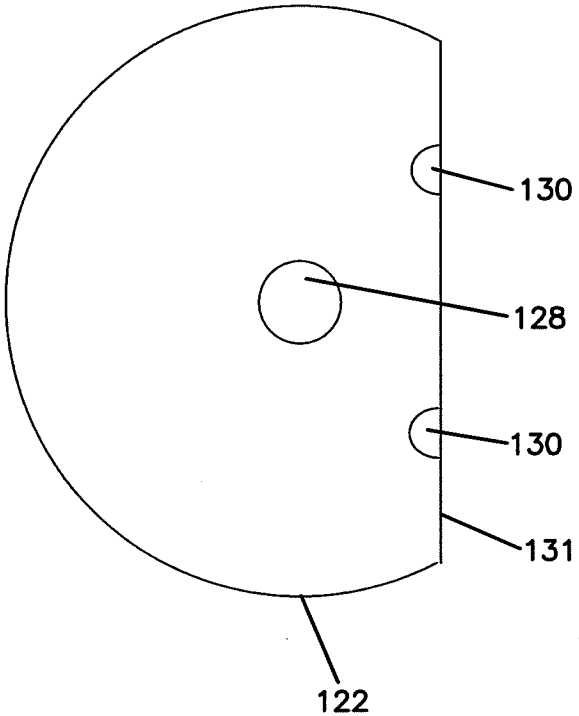
FIG. 9 is a top view of a bottom plate of the mounting bracket that is suitable for use with the door safety device of FIG. 1.
Figure 8:
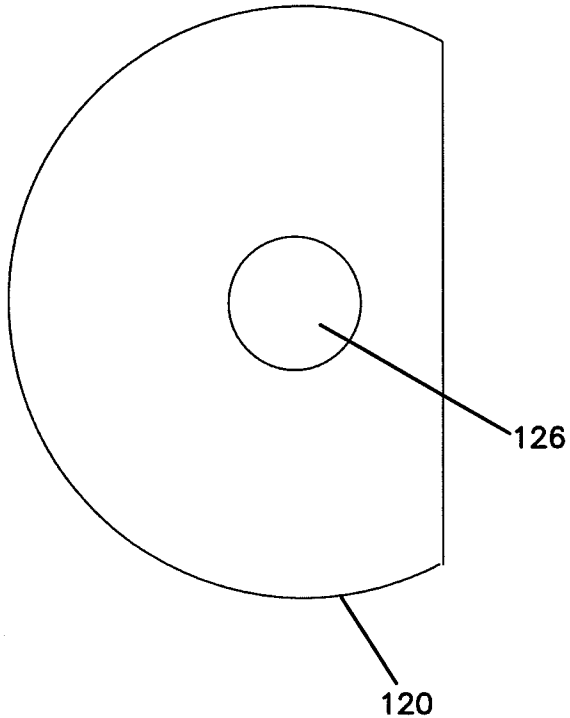
FIG. 8 is a top view of a top plate of a mounting bracket that is suitable for use with the door safety device of FIG. 1.

Referring now to FIGS. 1-3, an overhead door safety system 10 is shown. The overhead door safety system 10 includes a truck and trailer door safety device 100 that is constructed to be mounted on a loading dock wall 200. The loading dock wall 200 defines an opening 202 through which goods can be brought into a facility. In the present disclosure, the term "loading dock wall" includes any surface at or near the location of a loading dock that provides a suitable mounting surface, for example the exterior wall of a building or the door frame of the loading dock.

The truck and trailer door safety device 100 is adapted to retain an overhead door of a truck or trailer in an open position when the truck or trailer is backed into a loading dock location. In the present disclosure, the term "overhead door" includes all types of truck and/or trailer doors which open and close in a vertical direction, such as roll-up doors. For ease of description purposes, the term "truck" will be used herein to refer to trucks or trailers.

The truck and trailer door safety device 100 includes a swing arm 102 and a mounting bracket 104. In one aspect of the present disclosure, the swing arm 102 is pivotally connected to the mounting bracket 104 and the mounting bracket 104 is rigidly attached to the loading dock wall 200. In this configuration, the swing arm 102 is able to rotate to a retaining position such that a portion of the swing arm 102 is extended into a rear opening of the truck bay and beneath the open door of the truck. In this position, the swing arm 102 can support the weight of the door and any associated downward forces should the door start to close. Additionally, the swing arm 102 is able to rotate to a storage position such that no portion of the swing arm 102 is extended into the rear opening of the truck bay or below the overhead door thereby allowing the overhead door to be freely closed.

In operation, the swing arm 102 is generally in the storage position before a truck is backed into the loading dock area. After a truck has moved into this position, an operator would then vertically displace the overhead door to an open position and then move the swing arm 102 into the retaining position. In the particular embodiment shown in FIG. 1, the swing arm 102 is rotated horizontally into the retaining position. With the swing arm 102 in the retaining position, personnel can move freely between the truck bay and the loading dock without the risk that the overhead door will inadvertently fall on them, even if the goods being unloaded or loaded inadvertently strike the overhead door and create a closing force that acts on the overhead door. As such, worker safety is significantly increased.

Referring now to FIGS. 1-4, the swing arm 102 will be described. In one aspect of the present disclosure, the swing arm 102 includes an arm extension portion 106 and a pivot portion 108.

The arm extension portion 106 of the swing aim 102 is adapted to support the bottom edge of the overhead door D to prevent the door from moving in a downwards direction. The arm extension portion 106 includes a free end portion 109 that is oppositely disposed from the pivot portion 108 of the swing arm 102. In one aspect of the present disclosure, the free end portion 109 is arcuate (i.e., curved) in shape (best shown in FIGS. 3-4). Such a construction allows the arm extension portion 106 to be positioned towards an interior side of the truck when the swing arm 102 is in a retaining position under the overhead door. In one aspect of the present disclosure, the curvature of the free end portion 109 of the arm extension portion 106 is potentially advantageous as it allows for some misalignment between the truck and the loading dock area. The curved feature can also make the arm extension portion 106 more visible to a person who is walking directly towards the end of the arm extension portion 106, thereby increasing worker safety. Additionally, the curvature of the free end portion 109 may minimize damage to shipped goods or personnel should a collision with the arm extension portion 106 occur.

The arm extension portion 106 has a length "l", a height "h" and a thickness "t." It should be appreciated that the length "l" of the arm extension portion 106 should be long enough to allow the arm extension portion 106 to protrude into the opening of the truck bay from the mounting location of safety device 100. It should also be appreciated that the selection of the material, height "h" and thickness "t" for the arm extension portion 106 should be such that the arm extension portion 106 has the requisite structural integrity to support not only the weight of the truck overhead door, but the additional force of a door that has fallen from a fully open position down to the arm extension portion 106.

The pivot portion 108 of the swing arm 102 is adapted to allow the swing arm 102 to rotate about a pivot axis 110. In one aspect of the present disclosure, the pivot axis 110 is generally parallel to the loading dock wall 200. In another aspect of the present disclosure, the pivot axis 110 is vertical.

The pivot portion 108 defines a central bore 112 through which a pin or bolt, such as a pivot pin 114 of pivot assembly 116, can be inserted to support the swing arm 102 and to enable the swing arm 102 to rotate. In the depicted embodiment of FIGS. 1-4, the pivot portion 108 is rigidly attached to the arm extension portion 106. While the central bore 112 of the pivot portion 108 is shown as having an inner diameter that is greater than or equal to the thickness "t" of the arm extension portion 106, it will be appreciated that the swing arm 102 could be constructed so that the central bore 112 is located within the thickness "t" of the arm extension portion 106.

In the depicted embodiment, the central bore 112 extends completely through the pivot portion 108 of the swing arm 102. It should also be understood, however, that the central bore 112 could include partial recesses on opposite sides of the pivot portion 108 or the arm extension portion 106 rather than a full opening.

Referring now to FIGS. 1-3, 8 and 9, the mounting bracket 104 is adapted to be mounted to the loading dock wall 200 at a height that allows the swing arm 102 to engage the overhead door of the truck. The mounting bracket 104 includes a back plate 118, a top plate, 120 and a bottom plate 122. The back plate 118 defines a plurality of holes 124 through which mounting bolts or lag screws can be inserted to secure the mounting bracket 104 to the loading dock wall/door jamb 200. The back plate 118 of the mounting bracket 104 can also be welded to the loading dock wall/door jamb 200 in addition to, or instead of, using bolts or screws.

The top plate 120 and the bottom plate 122 are rigidly secured (e.g., welded, bolted, etc.) to the back plate 118. In one aspect of the present disclosure, the top and bottom plates 120, 122 are generally perpendicular to the back plate 118. The top plate 120 defines a first opening 126 while the bottom plate 122 defines a second opening 128. The first and second openings 126, 128 are adapted to receive the pivot pin 114 of the pivot assembly 116. The bottom plate 122 further defines a plurality of openings 130 that extend through the bottom plate 122. In the depicted embodiment of FIG. 9, the openings 130 are disposed adjacent to an edge 131 of the bottom plate 122 that abuts the back plate 118 of the mounting bracket 104. The plurality of openings 130 is adapted to allow any moisture that collects on the top surface of the bottom plate 122 to drain through the bottom plate 122.

Referring now to FIGS. 1, 2, 5 and 6, the mounting bracket 104 is shown as including a return guide 132. The return guide 132 is adapted to retain the swing arm 102 in a selected position, such as the retaining position or the storage position. The return guide 132 is configured to ensure that the swing arm 102 must be vertically displaced before it will rotate in one direction or the other. Such an arrangement prevents the swing arm 102 from freely rotating to an undesirable location. In the depicted embodiment of FIGS. 1-2 and 5-6, the return guide 132 includes a base 134 and a contact surface 136. The base 134 is rigidly secured to the bottom plate 122 of the mounting bracket 104. As shown, the contact surface 136 defines a plurality of peaks 138 and a plurality of trough portions 140, 142 and 144. When the swing arm 102 or a cam assembly 146, which will be described subsequently, is resting within any of the trough portions 140, 142 and 144, the swing arm 102 must be vertically displaced before it can be rotated. Thus the troughs 140, 142 and 144 will hold the swing arm 102 in either the storage position or the retaining position. Whether a particular trough 140, 142 or 144 holds the swing arm 102 in the storage or retaining position depends on which side of the loading dock the back plate 118 is mounted and whether the back plate 118 is mounted to a surface that is perpendicular to the overhead door or parallel to the overhead door. For example, if the mounting bracket 104 is mounted to a loading dock wall such that the back plate 118 is essentially parallel to the rear door of the truck, the troughs 140 and 144 would retain the swing arm 102 in the storage position while the trough 142 would retain the swing arm 102 in the retaining position.

The pivot assembly 116 is for supporting the swing arm 102 and for enabling the swing arm 102 to rotate about the pivot axis 110. The pivot assembly 116 includes the pivot pin 114. In the depicted embodiment, the pivot pin 114 includes a head 114*a* and a corresponding nut 114*b*, which is threadedly engaged to threads on a body of the pivot pin 114. In the depicted embodiment, the pivot assembly 116 further includes a plurality of washers 148.

The pivot pin 114 passes through the first opening 126 of the top plate 120, through the central bore 112 of the pivot portion 108 of the swing arm 102 and through the second opening 128 of the bottom plate 122. The pivot pin 114 is retained in the central bore 112 of the pivot portion 108 of the swing arm 102 by the head 114*a* and the nut 114*b* which abut the top and bottom plates 120, 122. In the depicted embodiment of FIG. 1, the head 114*a* of the pivot pin 114 abuts the bottom plate 122 while the nut 114*b* abuts the top plate 120. In the depicted embodiment of FIG. 2, the head 114*a* of the pivot pin 114 abuts the top plate 120 while the nut 114*b* abuts the bottom plate 122. While the pivot pin 114 has been shown as including a head 114*a* and a nut 114*b*, it will be understood that the head 114*a* of the pivot pin 114 could be another nut that is threaded onto the pivot pin 114. Further, it will be understood that other methods of securing the pivot pin 114 to the mounting bracket 104 are possible, such as by welding, cotter pins, rivets, etc.

In one aspect of the present disclosure, the pivot assembly 116 includes a compression spring 150. The compression spring 150 is adapted to provide a downward force against the swing arm 102 so that the swing arm 102 remains engaged with the contact surface 136 of the return guide 132. The compression spring 150 defines a bore through which the pivot pin 114 is disposed. The compression spring 150 is compressed between the top plate 120 and the pivot portion 108 of the swing arm 102. In one aspect of the present disclosure, the opening 126 in the top plate 120 is sized to allow the compression spring 150 to be inserted through the opening 126.

Referring now to FIGS. 1, 2, 4 and 7, the cam assembly 146 will be described. In the depicted embodiment, the cam assembly 146 is engaged to the swing arm 102. The cam assembly 146 is adapted to reduce the frictional forces between the swing arm 102 and the return guide 132 when the swing arm 102 is rotated to a desired position. While the truck and trailer door safety device 100 can be configured such that the arm extension portion 106 of the swing arm 102 is in direct contact with the contact surface 136 of the return guide 132, the cam assembly 146 provides a lower friction alternative that allows the swing arm 102 to rotate with little frictional resistance.

The cam assembly 146 includes a bracket 152, a follower bearing 154, a retaining nut 156 and a follower bearing axle 158. In the depicted embodiment of FIGS. 1-2 and 4, the follower bearing 154 is rotatably mounted to the bracket 152. The follower bearing 154 is disposed on the follower bearing axle 158 which passes through an opening 160 defined by the bracket 152. The retaining nut 156 retains the follower bearing axle 158 in the opening 160 of the bracket 152.

The bracket 152 is rigidly mounted onto the arm extension portion 106 so that follower bearing 154 will roll along the contact surface 136 of the return guide 132 as the swing arm 102 is rotating about the pivot axis 110. The friction associated with this rolling relationship is less than the friction associated with a sliding configuration. The bracket 152 defines a slot 162 that is adapted to receive the arm extension portion 106 of the swing arm 102.

Figure 10:
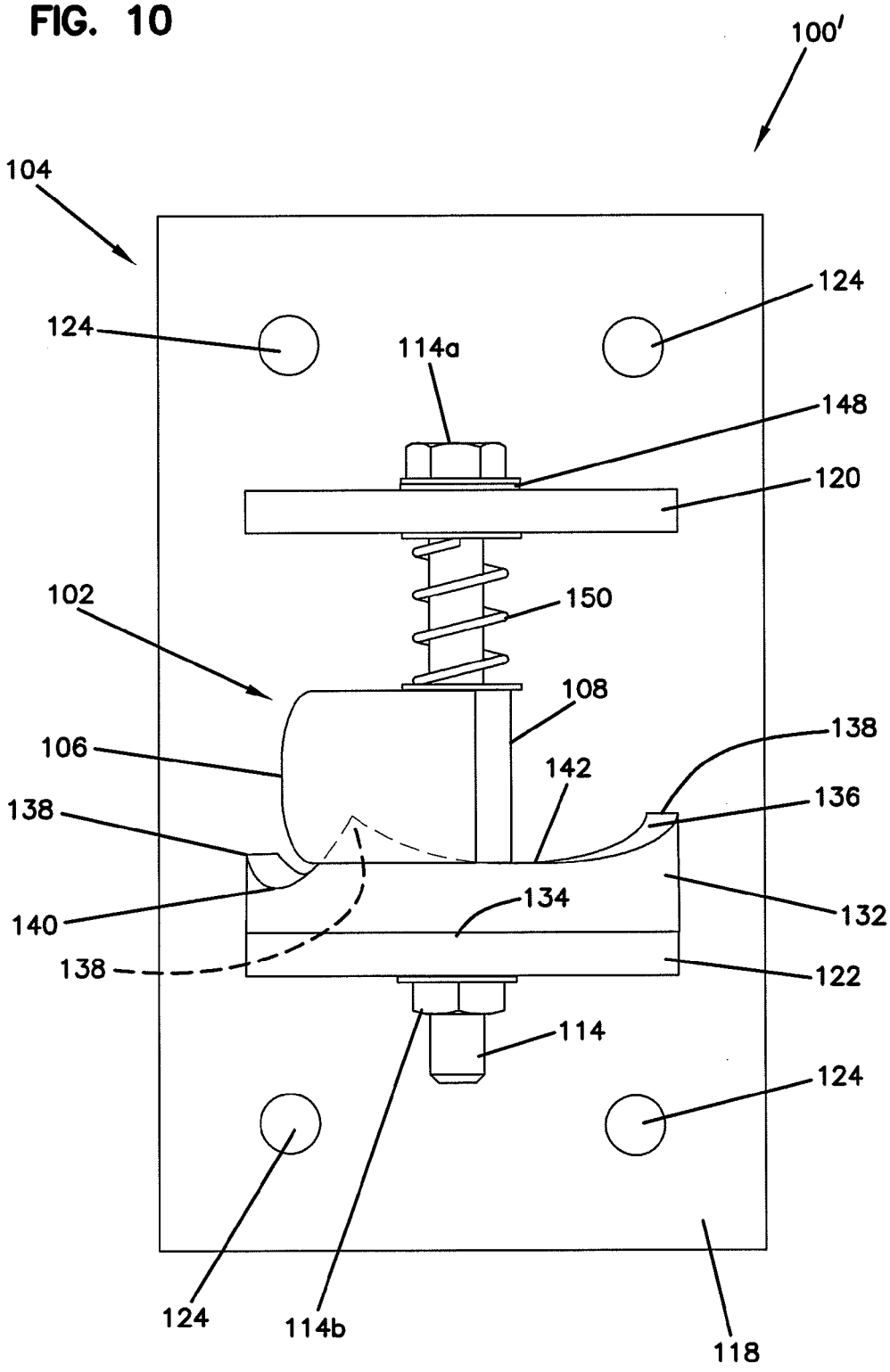
FIG. 10 is a front view of an alternate embodiment of a door safety device.
Figure 11:
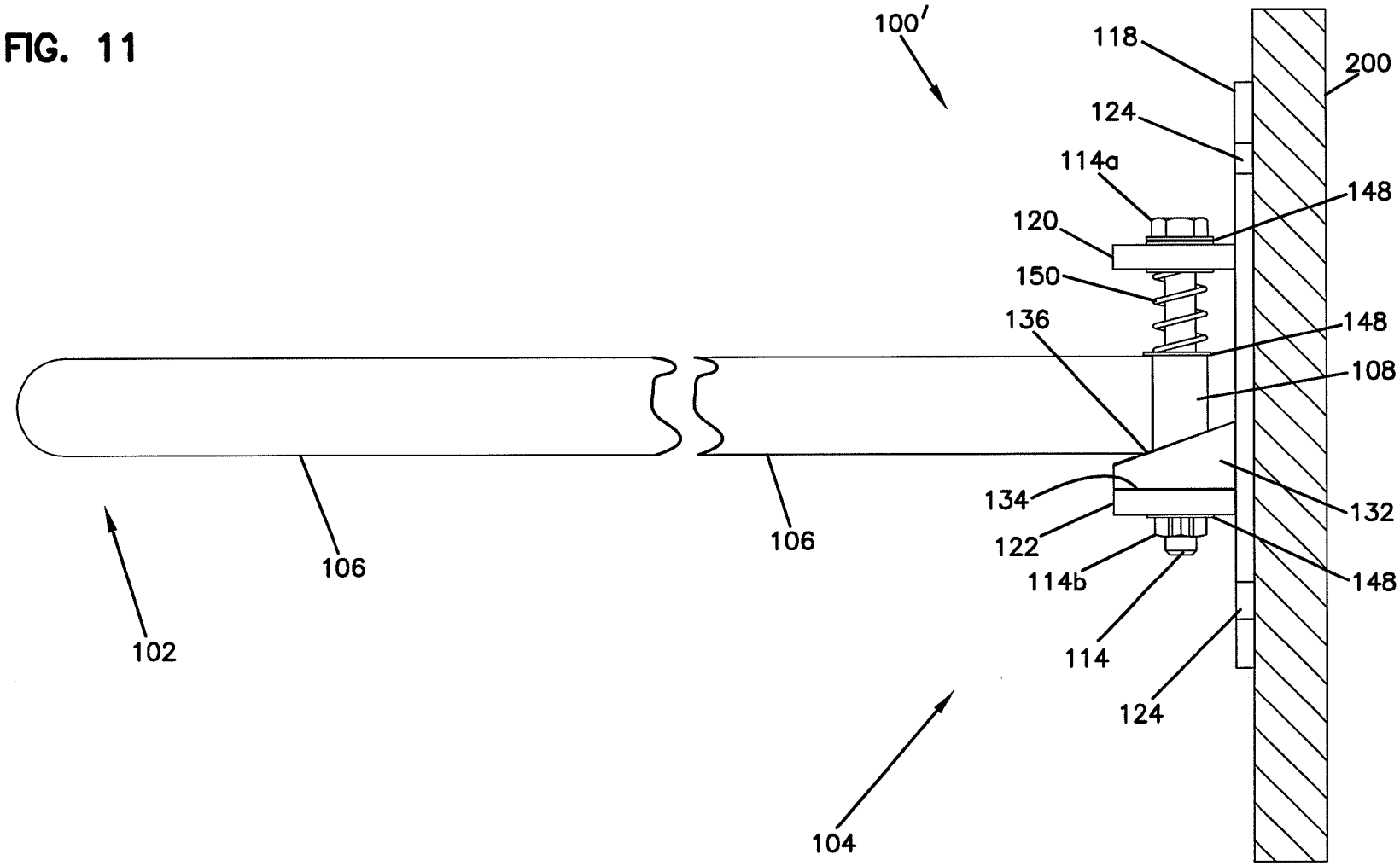
FIG. 11 is a side view of the door safety device of FIG. 10.

Referring now to FIGS. 10 and 11, a second embodiment of a truck and trailer door safety device 100' is shown. The truck and trailer door safety device 100' includes the features of the truck and trailer door safety device 100 described above with the exception of the cam assembly 146 and a slightly modified return guide 132. The description of all other features of the above described embodiment is herein incorporated into the description for this embodiment.

In the embodiment shown in FIGS. 10 and 11, the arm extension portion 106 is in direct contact with the contact surface 136 of return guide 132. In this embodiment, the swing arm 102 simply slides across the contact surface 136 when the swing arm 102 is being moved from the storage position to the retaining position, or vice versa. However, it should be noted that the embodiment shown in FIGS. 10-11 can also be configured so that a low friction material is disposed between the arm extension portion 106 and the contact surface 136 thereby reducing the necessary force to rotate the swing arm 102. Additionally, the return guide 132 and the arm extension portion 106 may be selected of materials that are known to have relatively lower coefficients of friction.

Figure 12:
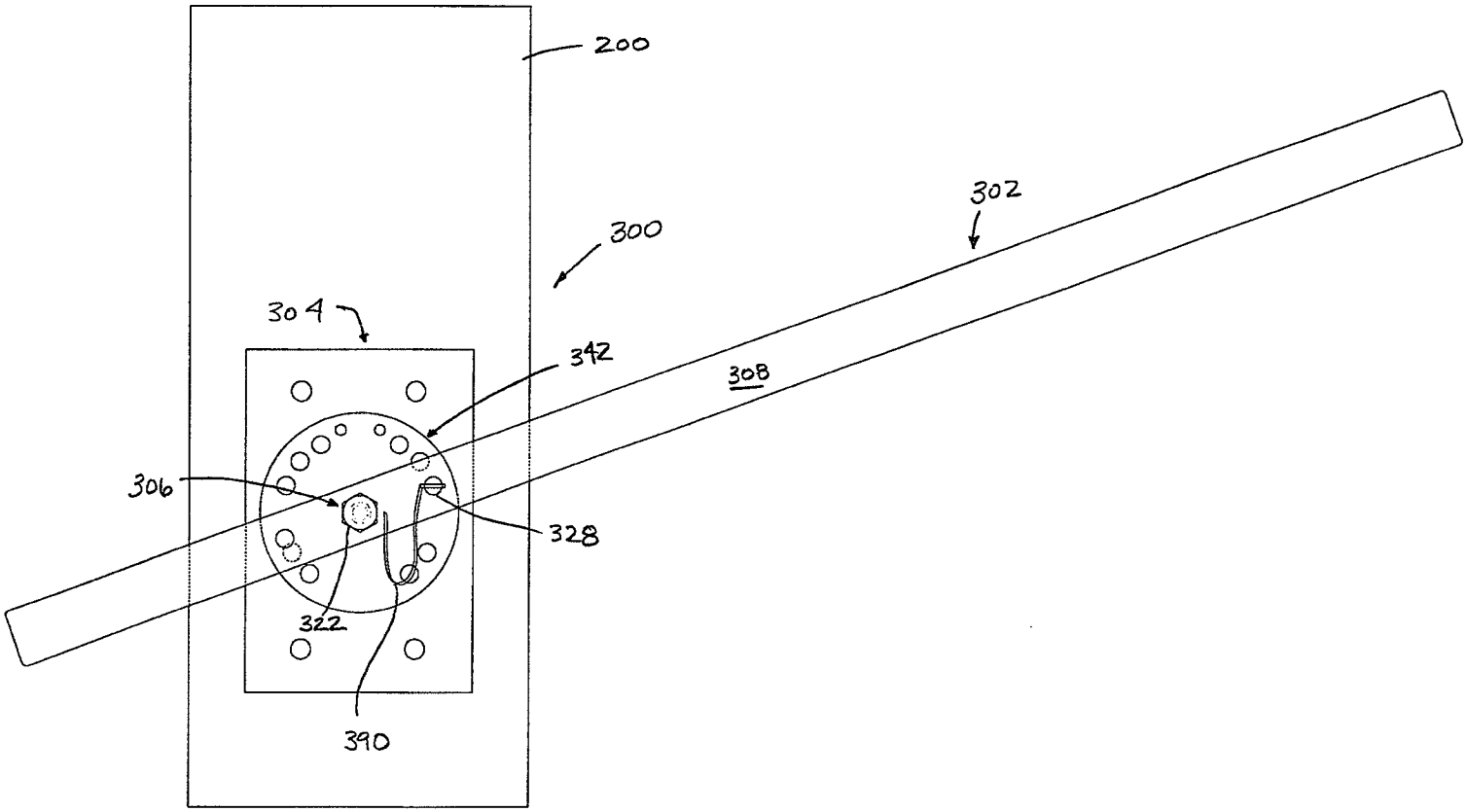
FIG. 12 is a front view of an alternate embodiment of a door safety device.
Figure 13:
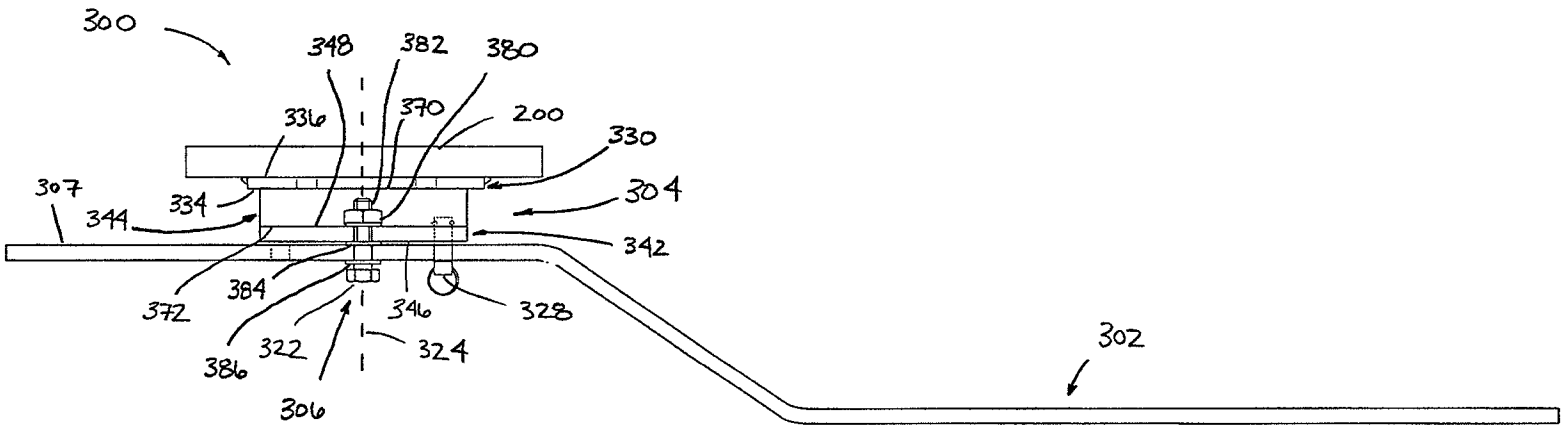
FIG. 13 is a top view of the door safety device of FIG. 12.

Referring now to FIGS. 12 and 13, an alternate embodiment of a truck and trailer door safety device 300 is shown. The truck and trailer door safety device 300 includes a swing arm 302 and a mounting bracket 304.

The swing arm 302 is pivotally engaged to the mounting bracket 304 through a pivot assembly 306. The swing arm 302 is adapted to pivot between a storage position, in which the swing arm 302 is disposed in a generally vertical position, and a retaining position (shown in FIG. 12).

Figure 14:
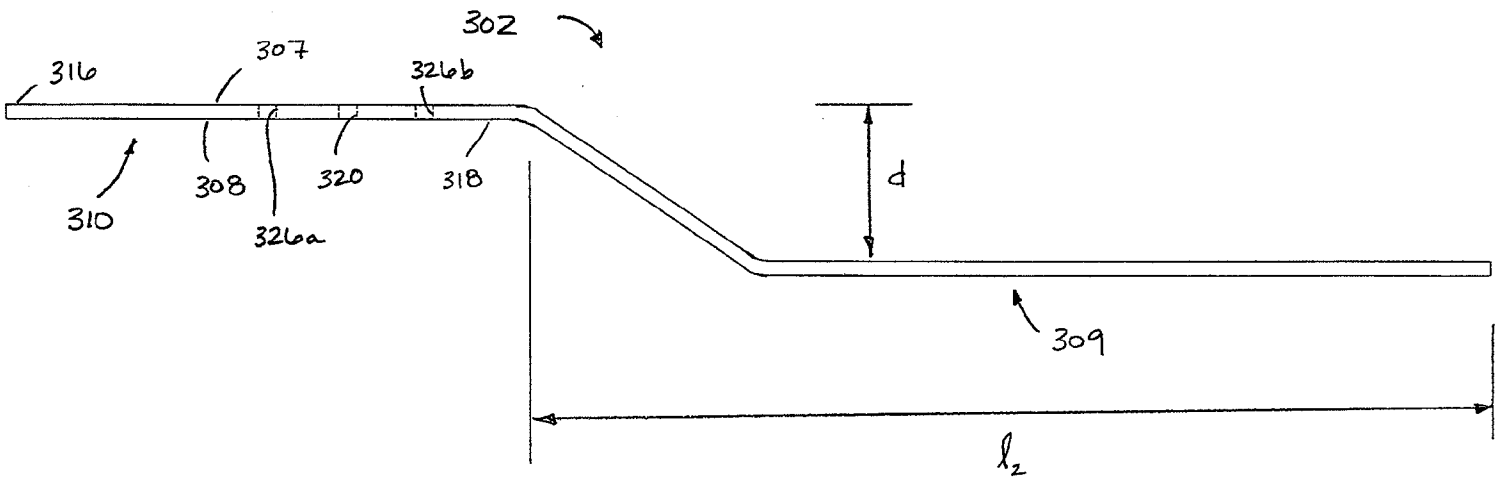
FIG. 14 is a top view of a swing arm that is suitable for use with the door safety device of FIG. 12.
Figure 15:
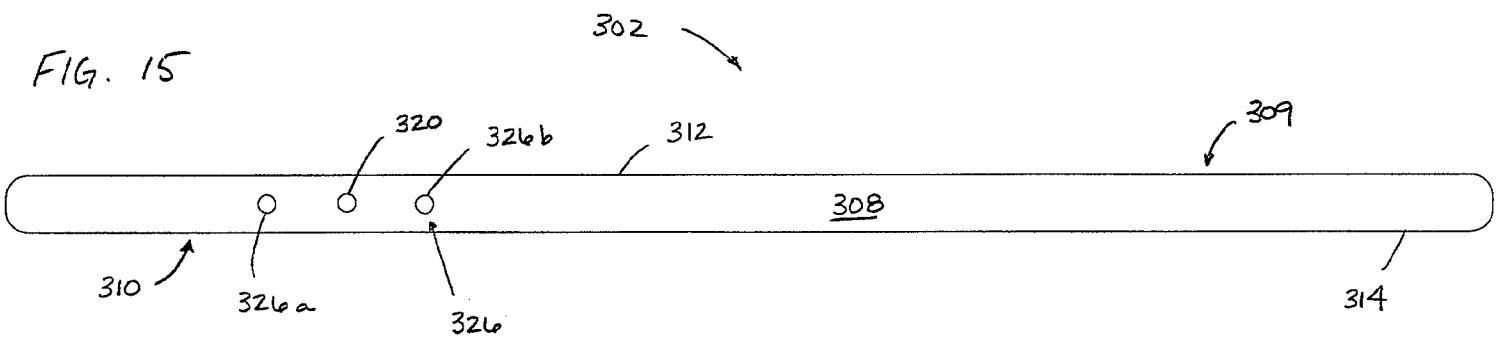
FIG. 15 is a front view of the swing arm of FIG. 14.

Referring now to FIGS. 14 and 15, the swing arm 302 is shown. The swing arm 302 includes a first surface 307 and an oppositely disposed second surface 308. The swing arm 302 further includes an arm extension portion 309 and a pivot portion 310. The arm extension portion 309 extends outwardly from the pivot portion 310 by an axial length "$l_2$." In one aspect of the present disclosure, the axial length $l_2$ is about 33 inches.

The arm extension portion 309 of the swing arm 302 is adapted to support the bottom edge of the overhead door to prevent the door from moving in a downward direction. The arm extension portion 309 includes a first end 312 and a second end 314. The first end 312 is engaged with the pivot portion 310. In one aspect of the present disclosure, the arm extension portion 309 is integral with the pivot portion 310. In another aspect of the present disclosure, the arm extension portion 309 and the pivot portion 310 are monolithic.

The second end 314 of the arm extension portion 309 is generally parallel to the pivot portion 310. In the depicted embodiment of FIGS. 14 and 15, the second end 314 is offset from the pivot portion 310 by a distance "d." In one aspect of the present disclosure, the distance "d" is about 3 inches. The offset of the second end 314 from the pivot portion 310 is potentially advantageous as it allows for some misalignment between the truck and the loading dock area.

The pivot portion 310 of the swing arm 302 includes a first end 316 and an oppositely disposed second end 318. In one aspect of the present disclosure, the second end 318 of the pivot portion 310 is engaged to the first end 312 of the arm extension portion 309.

The pivot portion 310 defines a pivot opening 320 that extends through the first and second surfaces 307, 308 of the swing arm 302. The pivot opening 320 is adapted to receive a pivot pin 322 (shown in FIGS. 12 and 13). The pivot opening 320 is sized so that the swing arm 302 can pivot about a pivot axis 324 (shown in FIG. 13), which extends through the pivot pin 322.

The pivot portion 310 further defines a latch opening 326. In one aspect of the present disclosure, the pivot portion 310 defines a first latch opening **326*a* and a second latch opening 326*b***.

The first latch opening **326*a* is disposed between the first end 316 and the pivot opening 320. The second latch opening 326*b* is disposed between the second end 318 and the pivot opening 320. Each of the first and second latch openings 326*a*, 326*b* is adapted to receive a latch pin 328 (shown in FIGS. 12 and 13**).

In one aspect of the present disclosure, the swing arm 302 is manufactured from a steel alloy. In another aspect of the present disclosure, the swing arm 302 is manufactured from A36 steel.

Figure 17:
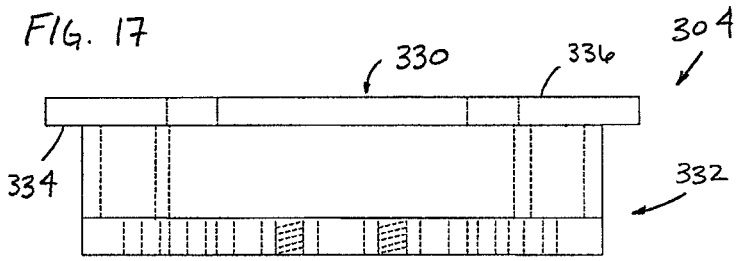
FIG. 17 is a top view of the mounting bracket of FIG. 16.
Figure 18:
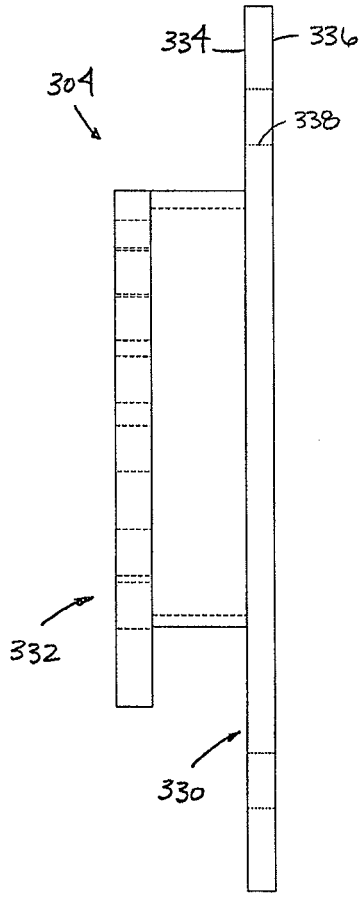
FIG. 18 is a side view of the mounting bracket of FIG. 16.

Referring now to FIGS. 16-18, the mounting bracket 304 will be described. The mounting bracket 304 includes a back plate 330 and a pivot plate assembly 332.

The back plate 330 is adapted to mount the truck and trailer door safety device 300 to the loading dock wall 200. In one aspect of the present disclosure, the back plate 330 includes a first surface 334 and an oppositely disposed second surface 336. When the mounting bracket 304 is mounted to the loading dock wall 200, the second surface 336 of the back plate 330 faces the loading dock wall 200. In one aspect of the present disclosure, the second surface 336 of the back plate 330 is disposed against the loading dock wall 200 (shown in FIGS. 12 and 13).

The back plate 330 is adapted to be fastened (e.g., bolted, welded, etc.) to the loading dock wall 200. The back plate 330 defines a plurality of mounting holes 338 disposed adjacent to an outer periphery 340 of the back plate 330. In one aspect of the present disclosure, the back plate 330 defines four mounting holes 338. The mounting holes 338 are sized to receive a plurality of fasteners (e.g., bolts, screws, etc.) that is adapted for engagement with the loading dock wall 200.

In one aspect of the present disclosure, the back plate 330 is manufactured from a steel alloy. In another aspect of the present disclosure, the back plate 330 is manufactured from A36 steel.

Referring now to FIGS. 16-22, the pivot plate assembly 332 will be described. The pivot plate assembly 332 is engaged to the first surface 334 of the back plate 330. In one aspect of the present disclosure, the pivot plate assembly 332 is centrally disposed on the back plate 330. The pivot plate assembly 332 includes a pivot plate 342 and a spacer 344. In one aspect of the present disclosure, the pivot plate 342 is generally parallel to the back plate 330.

The pivot plate 342 includes a first face 346 and an oppositely disposed second face 348. The pivot plate 342 defines an opening 350. The opening 350 extends through the first and second faces 346, 348 and is centrally disposed on the pivot plate 342. The opening 350 is sized to receive a portion of the pivot pin 322.

The pivot plate 342 further defines a first quadrant I, a second quadrant II, a third quadrant III and a fourth quadrant IV. The first quadrant I is bounded by a first plane 352 and a second plane 354, which is disposed at an angle of about 90° from the first plane 352. The second quadrant II is bounded by the second plane 354 and a third plane 356, which is disposed at an angle of about 180° the first plane 352. The third quadrant III is bounded by the third plane 356 and a fourth plane 358, which is disposed at an angle of 270° from the first plane 352. The fourth quadrant IV is bounded by the fourth plane 358 and the first plane 352.

The pivot plate 342 further defines a plurality of latch pin openings 360. The plurality of latch pin openings 360 extends through the first and second faces 346, 348 of the pivot plate 342. The plurality of latch pin openings 360 is arranged about a central axis 362 of the pivot plate 342 so that the radial distance from the central axis 362 of each of the latch pin openings 360 is equal.

The plurality of latch pin openings 360 is adapted to provide a retaining position of the swing arm 302 that is variable. The plurality of latch pin openings 360 is arranged so that the retaining position of the swing arm 302 is incrementally moveable. In one aspect of the present disclosure, the plurality of latch pin openings 360 is arranged so that the retaining position is moveable in increments of about 10°. In the depicted embodiment of FIGS. 16-22, the latch pin openings 360 disposed in the first quadrant I of the pivot plate 342 cooperate with the latch pin openings 360 in the third quadrant III of the pivot plate 342 to provide a finer incremental change in the retaining position of the swing arm 302.

In the depicted embodiment of FIGS. 16-20, the pivot plate 342 further defines a storage pin opening 364. The storage pin opening 364 is disposed in the first quadrant I of the pivot plate 342. In one aspect of the present disclosure, the storage pin opening 364 includes internal threads that are adapted for engagement with external threads of a storage pin. The engagement of the storage pin in the storage pin opening 364 is adapted to prevent the swing arm 302 from moving beyond the vertical position when the swing arm 302 is released from the retaining position. In one aspect of the present disclosure, the storage pin 364 is adapted to engage the first end 316 of the pivot portion 308 of the swing arm 302 when the swing arm 302 is in the storage position.

In one aspect of the present disclosure, the position of the latch pin openings 360 in the first and third quadrants I, III are mirrored in the second and fourth quadrants II, IV, respectively. In addition, the position of the storage pin opening 364 in the first quadrant I of the pivot plate 342 is mirrored in the second quadrant II. This mirroring of the first and fourth quadrants I, IV to the second and third quadrants II, III allows for the truck and trailer door safety device 300 to be used on opposing sides of an opening of the loading dock area.

In one aspect of the present disclosure, the pivot plate 342 is manufactured from a steel alloy. In another aspect of the present disclosure, the pivot plate 342 is manufactured from A36 steel.

Referring now to FIGS. 17, 18, 21 and 22, the spacer 344 is shown. The spacer 344 is disposed between the pivot plate 342 and the back plate 330. The spacer 344 includes a first axial end surface 370 and an oppositely disposed second axial end surface 372. The first axial end surface 370 is fastened to the first surface 334 of the back plate 330. In one aspect of the present disclosure, the first axial end surface 370 is welded to the first surface 334 of the back plate 330.

The second axial end surface 372 of the spacer 344 is fastened to the second face 348 of the pivot plate 342. In one aspect of the present disclosure, the second axial end surface 372 of the spacer 344 is welded to the second face 348 of the pivot plate 342.

The spacer 344 is generally cylindrical in shape. The spacer 344 defines a central bore 374 that extends through the first and second axial end surfaces 370, 372. The spacer 344 includes an outer circumferential surface 376. In one aspect of the present disclosure, the outer circumferential surface 376 defines a longitudinal opening 378. The longitudinal opening 378 extends from the first axial end surface 370 to the second axial end surface 372 and provides access to the central bore 374. This access to the central bore 374 is potentially advantageous as it aids in the assembly and disassembly of the swing arm 302 from the mounting bracket 304.

In one aspect of the present disclosure, the spacer 344 is manufactured from a steel alloy. In another aspect of the present disclosure, the spacer 344 is manufactured from A36 steel.

Referring now to FIGS. 12-22, the installation of the swing arm 302 will be described. The mounting bracket 304 is mounted to the loading dock wall 200. The first surface 307 of the swing arm 302 is positioned adjacent to the first face 346 of the pivot plate 342. The pivot opening 320 of the pivot portion 310 of the swing arm 302 is then aligned with the opening 350 of the pivot plate 342.

With the pivot opening 320 and the opening 350 aligned, the pivot assembly 306 is engaged to the swing arm 302 and the mounting bracket 304. In one aspect of the present disclosure, the pivot assembly 306 includes the pivot pin 322 and a retainer 380.

The pivot pin 322 is inserted in to the pivot opening 320 of the swing arm 302 and the opening 350 of the pivot plate 342. The retainer (e.g., nut, cotter pin, crimp, etc.) 380 is engaged with an end portion 382 of the pivot pin 322 that is disposed in the central bore 374 of the spacer 344. The retainer 380 is adapted to prevent the inadvertent removal of the pivot pin from the pivot opening 320 in the swing arm 302 and the opening 350 in the pivot plate 342.

In one aspect of the present disclosure, the pivot assembly 306 further includes a first washer 384. The first washer 384 is disposed between the first surface 307 of the swing arm 302 and the first face 346 of the pivot plate 342. The first washer 384 axially offsets the first surface 307 of the swing arm 302 from the first face 346 of the pivot plate 342. This axial offset reduces friction between the swing arm 302 and the pivot plate 342.

In another aspect of the present disclosure, the pivot assembly 306 includes a second washer 386. The second washer 386 is disposed between the second surface 308 of the swing arm 302 and the pivot pin 322.

With the swing arm 302 engaged to the mounting bracket 304 through the pivot assembly 306, the swing arm 302 can rotate about the pivot axis 324 of the pivot assembly 306. In one aspect of the present disclosure, the pivot axis 324 is generally perpendicular to the loading dock wall 200. In another aspect of the present disclosure, the pivot axis 324 is generally perpendicular to the back plate 330. In another aspect of the present disclosure, the pivot axis 324 is generally horizontal.

A method for retaining an overhead door will now be described. With the mounting bracket 104, 304 mounted to the loading dock wall 200, a truck is backed into a loading dock area. The overhead door at the rear of the truck is then moved to an open position to expose the interior of the truck bay. The swing arm 102, 302 is then rotated about the pivot axis 110, 324 into the retaining position so that at least a portion of the swing arm 102, 302 extends into the truck bay interior below the overhead door.

In one aspect of the present disclosure, a latch pin 328 is inserted through one of the latch openings 326 in the swing arm 302 and one of the latch pin openings 360 of the pivot plate 342 to hold the swing arm 302 in the retaining position.

To release the overhead door, the latch pin 328 is removed from one of the latch openings 326 in the swing arm 302 and one of the latch pin openings 360 of the pivot plate 342. In one aspect of the present disclosure, the latch pin 328 is tethered to one of the swing arm 302, the mounting bracket 304 and the pivot assembly 306 by a tether 390. The tether 390 reduces the risk of the latch pin 328 being misplaced when the latch pin 328 is removed from the swing arm 302 and mounting bracket 304.

The swing arm 102, 302 is then rotated about the pivot axis 110, 324 to the storage position. In one aspect of the present disclosure, a fastener is engaged with the storage pin opening 364 of the pivot plate 342 to prevent the swing arm 302 from moving beyond the vertical position when the swing arm 302 is released from the retaining position. Also, when swing arm 302 is in the retaining position, the end 316 of the swing arm 302 functions to block the loading dock door from being closed. However, when the swing arm 302 is moved to the storage position, the end 316 no longer blocks the loading dock door. This feature prevents an operator from inadvertently leaving the swing arm 302 in the retaining position when the loading dock is unattended, where it is possible that the swing arm 302 can cause damage to the closed door of a truck or trailer being backed into the loading dock area.

Referring now to FIGS. 23-26, an alternate embodiment of a truck and trailer door safety device 500 is shown. The truck and trailer door safety device 500 is similar to the truck and trailer door safety device 300, which was previously described. It will be understood that while not all of the features described above will be described with regard to this embodiment, the truck and trailer door safety device 500 can include any of these features. Features which are similar to those described above will have the same reference numeral. Features which are new will have reference numbers greater than 500.

The truck and trailer door safety device 500 includes the swing arm 302 and the mounting bracket 304. In the depicted embodiment, the swing arm 302 includes a tether opening 502. The tether opening 502 extends through the first and second surfaces 307, 308 of the swing arm 302. In the depicted embodiment, the tether opening 502 is disposed between the pivot opening 320 and one of the first and second latch openings 326*a*, 326*b*.

The tether opening 502 is adapted to receive a fastener 504 (e.g., screw, bolt, pin, etc.). The fastener 504 is adapted to secure the tether 390 to the swing arm 302. In the depicted embodiment, the fastener 504 includes external threads that are adapted for engagement with internal threads in the tether opening 502.

The pivot plate 342 of the mounting bracket 304 includes the plurality of latch pin openings 360. In the depicted embodiment of FIGS. 23-25, the pivot plate 342 does not include the storage pin openings.

Referring now to FIGS. 27 and 28, an alternate embodiment of truck and trailer door safety device 700 is shown mounted to the loading dock wall 200. The truck and trailer door safety device 700 includes a swing arm 702 and a mounting bracket 704.

Referring now to FIGS. 29 and 30, the swing arm 702 is shown. The swing arm 702 includes a first surface 707 and an oppositely disposed second surface 708. The swing arm 702 further includes an arm extension portion 709 and a pivot portion 710. The swing arm also includes a short end 716 that functions in a manner similar to that described for end 316 of swing arm 302.

The arm extension portion 709 of the swing arm 702 is adapted to support the bottom edge of the overhead door to prevent the door from moving in a downward direction. The arm extension portion 709 is disposed at an angle $\alpha$ from the pivot portion 710. In the depicted embodiment, the angle $\alpha$ is measured from the first surface 707 of the pivot portion 710 to the first surface 707 of the arm extension portion 709. In one embodiment, the angle $\alpha$ is an oblique angle. In another embodiment, the angle $\alpha$ is in a range of about 135 to about 175 degrees. In another embodiment, the angle $\alpha$ is in a range of about 155 to about 175 degrees. In another embodiment, the angle $\alpha$ is about 165 degrees. The angle $\alpha$ is potentially advantageous as it allows for some misalignment between the truck and the loading dock area.

The pivot portion 710 defines a pivot opening 720 that extends through the first and second surfaces 707, 708 of the swing arm 702. The pivot opening 720 is adapted to receive a pivot pin 722 (shown in FIG. 27). The pivot opening 720 is sized so that the swing arm 702 can pivot about a pivot axis 724 (shown in FIG. 27), which extends through the pivot pin 722.

The pivot portion 710 further defines a first latch opening 726*a* and a second latch opening 726*b* disposed on opposite sides of the pivot opening 720. Each of the first and second latch openings 726*a*, 726*b* is adapted to receive a latch pin 728 (shown in FIG. 27).

Referring now to FIGS. 31-33, the mounting bracket 704 is shown. The mounting bracket 704 includes a back plate 730 and a pivot plate assembly 732.

The back plate 730 is adapted to mount the truck and trailer door safety device 700 to the loading dock wall 200. In one aspect of the present disclosure, the back plate 730 includes a first surface 734 and an oppositely disposed second surface 736. When the mounting bracket 704 is mounted to the loading dock wall 200, the second surface 736 of the back plate 730 faces the loading dock wall 200. In one aspect of the present disclosure, the second surface 736 of the back plate 730 is disposed against the loading dock wall 200 (shown in FIG. 27).

In the depicted embodiment, the back plate 730 defines a plurality of mounting holes 738 disposed adjacent to an outer periphery 740 of the back plate 730. In one aspect of the present disclosure, the back plate 730 defines six mounting holes 738. The mounting holes 738 are sized to receive a plurality of fasteners (e.g., bolts, screws, etc.) that is adapted for engagement with the loading dock wall 200. In another embodiment, a weld 741 (shown in FIG. 27) can fasten the back plate 730 to the loading dock wall 200.

The pivot plate assembly 732 is engaged to the first surface 734 of the back plate 730. The pivot plate assembly 732 includes a pivot plate 742 and a spacer 744. In one aspect of the present disclosure, the pivot plate assembly 732 is configured so that the pivot plate 742 is disposed at an oblique angle $\alpha_1$ relative to the back plate 730. The oblique angle $\alpha_1$ opens in a direction toward an exterior side 743 (shown in FIG. 27) of the loading dock wall 200. In one embodiment, the oblique angle $\alpha_1$ is greater than about 45 degrees. In another embodiment, the oblique angle $\alpha_1$ is in a range of about 54 degrees to about 58 degrees.

The pivot plate 742 is structurally similar to the pivot plate 342 described above. It will be understood that any of the features described with regard to the pivot plate 342 can be included in the pivot plate 742.

Referring now to FIGS. 34-35, the spacer 744 is shown. The spacer 744 is disposed between the pivot plate 742 and the back plate 730. The spacer 744 is generally cylindrical in shape and includes a first axial end surface 770 and an oppositely disposed second axial end surface 772. The first axial end surface 770 is fastened (e.g., welded, bolted, etc.) to the first surface 734 (shown in FIG. 31) of the back plate 730 while the second axial end surface 772 is fastened (e.g., welded, bolted, etc.) to the pivot plate 742 (shown in FIG. 31).

The first axial end surface 770 is disposed at an oblique angle $\alpha_2$ to the second axial end surface 772. In the depicted embodiment, the oblique angle $\alpha_2$ between the first and second axial end surfaces 770, 772 is equal to the oblique angle $\alpha_1$ between the pivot plate 742 and the back plate 730.

The spacer 744 defines a central bore 774 that extends through the first and second axial end surfaces 770, 772. The spacer 744 includes an outer circumferential surface 776. In one aspect of the present disclosure, the outer circumferential surface 776 defines a longitudinal opening 778. The longitudinal opening 778 extends from the second axial end surface 772 in a direction toward the first axial end surface 770 and provides access to the central bore 774. This access to the central bore 774 is potentially advantageous as it aids in the assembly and disassembly of the swing arm 702 from the mounting bracket 704.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. An overhead door safety system comprising:

a loading dock having a loading dock wall defining an opening;

a truck and trailer door safety device mounted to the loading dock wall, the truck and trailer door safety device including:

a mounting bracket adapted for mounting at the loading dock wall; and a swing arm having an arm extension portion and a pivot portion, the pivot portion being pivotally mounted to the mounting bracket so that the swing arm pivots about a pivot axis between a retaining position and a storage position, wherein the arm extension portion is disposed beneath an overhead door of a truck positioned adjacent to the opening of the loading dock wall to prevent the overhead door from closing when the swing arm is in the retaining position.

2. The overhead door safety system of claim 1, wherein the pivot axis is parallel to the loading dock wall.

3. The overhead door safety system of claim 1, wherein the pivot axis is perpendicular to the loading dock wall.

4. The overhead door safety system of claim 1, further comprising a pivot pin along the pivot axis about which the swing arm pivots.

5. The overhead door safety system of claim 4, further comprising a return guide having a contact surface that supports the swing arm.

6. The overhead door safety system of claim 5, further comprising a cam assembly fixedly mounted to the swing arm and having a follower bearing that travels along the contact surface of the return guide, the follower bearing being for reducing the friction between the swing arm and the contact surface of the return guide.

7. The overhead door safety system of claim 5, wherein the contact surface defines a plurality of peak portions and a plurality of trough portions, wherein the peak portions and the trough portions are alternatingly disposed.

8. The overhead door safety system of claim 7, further comprising a compression spring that urges the follower bearing against the contoured profile and further retains the swing arm in the desired position.

9. The overhead door safety system of claim 1, wherein the arm extension portion of the swing arm is curved.

10. A method of preventing a truck overhead door that is in an open position from unintentionally moving to a closed position, the method comprising the steps of:

backing a truck having the overhead door to a loading dock location;

opening the overhead door to the open position;

moving a swing arm of a truck and trailer door safety device to a retaining position wherein at least a portion of the swing arm is extended below the overhead door that is in the open position, wherein the truck and trailer door safety device is mounted to a loading dock wall.

11. The method of claim 10, wherein the step of moving the swing arm to a retaining position includes rotating the swing arm about a vertical pivot axis.

12. The method of claim 10, wherein the step of moving the swing arm to a retaining position includes rotating the swing arm about a horizontal pivot axis.

13. The method of claim 10, wherein the truck and trailer door safety device includes a mounting bracket and the swing arm pivotally mounted to the mounting bracket.

14. The method of claim 13, further comprising inserting a latch pin in a latch pin opening of the mounting bracket to secure the swing arm in the retaining position.

* * * * *